US006396508B1

(12) United States Patent
Noecker

(10) Patent No.: US 6,396,508 B1
(45) Date of Patent: May 28, 2002

(54) DYNAMIC LOW-LEVEL ENHANCEMENT AND REDUCTION OF MOVING PICTURE DISTURBANCE FOR A DIGITAL DISPLAY

(75) Inventor: James D. Noecker, Saugerties, NY (US)

(73) Assignee: Matsushita Electronics Corp., Osaka (JP)

( * ) Notice: Subject to any disclaimer, the term of this patent is extended or adjusted under 35 U.S.C. 154(b) by 0 days.

(21) Appl. No.: 09/452,970

(22) Filed: Dec. 2, 1999

(51) Int. Cl.[7] ..... G09G 3/28
(52) U.S. Cl. ..... 345/693; 345/63
(58) Field of Search ..... 345/60, 63, 690, 345/691, 692, 693; 348/671, 687

(56) References Cited

U.S. PATENT DOCUMENTS 5,757,343 A * 5/1998 Nagakubo ..... 345/63

FOREIGN PATENT DOCUMENTS

| | | | | |
|---|---|---|---|---|
| EP | 0919984 A2 | | 6/1999 | ..... G09G/3/28 |
| EP | 0919984 A3 | | 8/1999 | ..... G09G/3/28 |
| JP | 08311647 | | 11/1996 | |
| JP | 10171403 A | * | 6/1998 | ..... G09G/3/28 |
| JP | 10176863 | | 6/1998 | |
| JP | 10207426 A | * | 8/1998 | ..... G09G/3/28 |
| JP | 10214058 A | * | 8/1998 | ..... G09G/3/28 |
| JP | 10282929 A | * | 10/1998 | ..... G09G/3/28 |

OTHER PUBLICATIONS

"A Full Color AC Plasma Display with 256 Gray Scale," by Yoshikawa et al., Japan Display, 1992, pp. 605–608.
European Search Report. EP 00310732.

* cited by examiner

*Primary Examiner*—Richard Hjerpe
*Assistant Examiner*—Alexander Eisen
(74) *Attorney, Agent, or Firm*—Ohlandt, Greeley, Ruggiero & Perle, L.L.P.

(57) ABSTRACT

There is provided a method and system for improving an image on a display that images pixels. Each of the pixels has an intensity represented by a respective pixel value, an intensity of a given pixel being associated with a number of pulses produced within a set of subfields in a frame-time, and the pulses allocated among the set of subfields in accordance with a pulse distribution. The method comprises the steps of determining a maximum pixel value to be imaged during the frame-time, and altering a number of pulses within a given subfield based on the maximum pixel value, thus modifying the pulse distribution. The system is implemented in a circuit that executes the method steps.

39 Claims, 35 Drawing Sheets

8 SUBFIELD SP WEIGHTING FOR 8-BIT GRAYSCALE

PWM 12 SUBFIELD SP WEIGHTING FOR 8-BIT GRAYSCALE

8 SUBFIELD SP WEIGHTING FOR 8-BIT GRAYSCALE

12 SUBFIELD SP WEIGHTING FOR 8-BIT GRAYSCALE

PWM 12 SUBFIELD SP WEIGHTING FOR 8-BIT GRAYSCALE

CONVENTIONAL SP DISTRIBUTION FOR 12 SFs (THRESHOLD 0)

THRESHOLD 1 SP DISTRIBUTION

THRESHOLD 2 SP DISTRIBUTION

THRESHOLD 3 SP DISTRIBUTION

USING FRACTIONAL SPs TO ALLOW PSUEDO 10-BIT GRAYSCALE AT THRESHOLD 2

USING FRACTIONAL SPs TO ALLOW PSUEDO 12-BIT GRAYSCALE AT THRESHOLD 4

THRESHOLD 0 – ORIGINAL 12 SF DISTRIBUTION

THRESHOLD 1 - 11 SFs REDISTRIBUTED OVER 12 SFs

THRESHOLD 2 – 10 SFs REDISTRIBUTED OVER 12 SFs

THRESHOLD 3 - 9 SFs REDISTRIBUTED OVER 12 SFs

THRESHOLD 4 – 8 SFs REDISTRIBUTED OVER 12 SFs

13 SF REDISTRIBUTION DERIVED FROM 10 SFs USED, 2 UNUSED

14 SF REDISTRIBUTION DERIVED FROM 8 SFs USED, 4 UNUSED

DYNAMIC LOW-LEVEL ENHANCEMENT AND REDUCTION OF MOVING PICTURE DISTURBANCE FOR A DIGITAL DISPLAY

FIELD OF THE INVENTION

The present invention relates to video displays and more particularly, to a method and system for improving the image quality of a display in which a pixel is illuminated by pulses generated in subfields of a frame of the image in accordance with a pulse distribution function. A maximum pixel value to be imaged during the frame is determined, and the pulse distribution is modified based on the maximum pixel value. The invention is particularly suited for use with plasma display panels.

BACKGROUND OF THE INVENTION

Digital displays such as alternating current (AC) Plasma Display Panels (PDPs) are evolving as an attractive choice to view television programming, especially with regard to the emerging digital television and high definition television (DTV/HDTV) formats. Conventional cathode ray tubes (CRTs) have an established high picture quality, and PDPs are striving to achieve a similar quality in order to attract widespread consumer acceptance.

PDPs, i.e., gas discharge panels, are well known in the art and, in general, comprise a structure including a pair of substrates respectively supporting column and row electrodes, each coated with a dielectric layer and disposed in parallel spaced relation to define a gap therebetween in which an ionizable gas is sealed. The substrates are arranged such that the electrodes are disposed in orthogonal relation to each other, thereby defining points of intersection which, in turn, define discharge pixel sites at which selective discharges may be established to provide a desired storage or display function.

It is known to operate such panels with AC voltages and particularly to provide a write voltage which exceeds a firing voltage at a given discharge site, as defined by selected column and row electrodes, thereby to produce a discharge at a selected cell. The discharge can be continuously "sustained" by applying an alternating sustain voltage, which, by itself, is insufficient to initiate a discharge. The technique relies upon wall charges generated on the dielectric layers of the substrates which, in conjunction with the sustain voltage, operate to maintain continuing discharges.

Referring to FIG. 1, the structure of a full color AC plasma panel is schematically illustrated. Plasma panel 410 includes a back substrate 412 upon which plural column address electrodes 414 are supported. Column address electrodes 414 are separated by barrier ribs 416 and are covered by red, green and blue phosphors 418, 420 and 422, respectively. A front transparent substrate 424 includes a-pair of sustain electrodes 426 and 428 for each row of pixel sites. A dielectric layer 430 is emplaced on front substrate 424 and a magnesium oxide overcoat layer 432 covers the entire lower surface thereof, including all of sustain electrodes 426 and 428.

The structure of FIG. 1 is sometimes called a single substrate AC plasma display since both sustain electrodes 426 and 428, for each row, are on a single substrate of the panel. An inert gas mixture is positioned between substrates 412 and 424 and is excited to a discharge state by sustain voltages applied by sustain electrodes 426 and 428. The discharging inert gas produces ultra-violet light that excites the red, green and blue phosphor layers 418, 420 and 422, respectively to emit visible light. If the driving voltages applied to column address electrodes 414 and sustain electrodes 426, 428 are appropriately controlled, a full color image is visible through front substrate 424.

In order to cause the AC plasma panel of FIG. 1 to exhibit a full color image for applications such as television or computer display terminals, a means of achieving a gray scale is needed. Since it is desirable to operate AC plasma panels in a memory mode to achieve high luminance and low flicker, an addressing technique is utilized to achieve image gray levels in pixels that only exist in the ON or OFF states. Such addressing technique is described by Yoshikawa et al. in "A Full Color AC Plasma Display With 256 Gray Scale", Japan Display, 1992, pp. 605–608. Because a PDP is a digital device, it can provide only affixed number of gray scale gradations. In the case of an 8-bit red-green-blue (RGB) signal, 256 gradations are possible.

FIG. 2 illustrates the driving sequence used by Yoshikawa et al. to achieve a 256 gray scale. The drive sequence is sometimes called the sub-field addressing method. The plasma. display panel is addressed in a conventional video manner that divides images into frames. A typical video image may be presented at 60 frames per second, which corresponds to a frame time of 16.6 milliseconds. The sub-field addressing method shown in FIG. 2. divides each frame into 8 sub-fields, SF1–SF8.

As shown in FIG. 3,.each of the 8 sub-fields is further divided into an address period and a sustain period. During the sustain period, a sustain voltage is applied to sustain electrodes 426 and 428, shown in FIG. 1. Thus, if a given pixel site is in the ON state, it is caused to emit light by one or more sustain pulses. By contrast, the sustain voltage is insufficient to cause a discharge at any pixel site that is in the OFF state.

Note in FIG. 2 that the length of the sustain period of each of the 8 sub-fields is different. The first sub-field has a sustain period with only 1 complete sustain cycle period. The second sub-field has 2 sustain cycles, the third sub-field has a sustain period with 4 sustain cycles and, so forth, until the 8th sub-field which has a sustain period with 128 sustain cycles.

By controlling the sustaining of a given pixel site that has been addressed, the perceived intensity of the pixel site can be varied to any one of the 256 gray scale levels. Suppose it is desired for a selected pixel site to emit at half-intensity or at level 128 out of 256. In such a case, referring to FIG. 1, a selective write address pulse is applied to the pixel site during sub-field 8 by applying an appropriate voltage to a column address electrode 414, and utilizing one of sustain lines 426, 428 as the opposing address conductor. No address pulses are applied during the other sub-fields to the addressed pixel site. This means that during the first 7 sub-fields, there is no writing action and therefore no light is emitted during the sustain periods. However, for sub-field 8, the selective write action turns ON the selected pixel site and causes an emission of light therefrom during the sub-field 8 sustain period, in this case for 128 sustain cycles. The 128 sustain cycle per frame energization corresponds to a half-intensity for a frame time.

If, alternatively, it is desired for the selected pixel site to emit at one-quarter intensity or at level 64 out of 256, then a selective write address pulse is applied to the pixel site during sub-field 7 and no address pulses are applied during the other sub-fields. Thus, during sub-fields 1, 2, 3, 4, 5, 6 and 8, there is no writing and therefore no light is emitted during the respective sustain periods. However, for sub-field 7, the selective write turns ON the selected pixel site and causes an emission of light during the sub-field sustain period (in this case, for 64 sustain cycles corresponding to a 1-quarter intensity). For a full-intensity case, the selective write address pulse is applied during all 8 sub-fields so that the pixel site emits light for all sustain periods for each of the 8 sub-fields, corresponding to a full-intensity for the frame.

The Yoshikawa et al. procedure enables any of 256 different intensities to be achieved-through the action of a display processor supplying an 8-bit data word for each sub-pixel site, the data word corresponding to the desired gray intensity level. By routing each of the bits of the data word to control the selective write pulse of each of the 8 address periods of the 8 sub-fields in a given frame, the 8-bit data word controls the number-of sustain cycles during which the selected pixel site will emit light for that frame. Thus, any integer number of sustain cycles per frame between and including 0–255 is obtainable.

FIG. 4 shows a standard sustain pulse distribution over 8 subfields for an 8-bit grayscale. In an 8-subfield system, the sustain pulse distribution is binary-weighted. That is, each subsequent subfield will contain twice the number of pulses as the previous subfield.

However, a PDP system is not limited to 8 subfields per frame. Japanese Patent No. Application No. 10-176863 describes a system in which the pulses for the 8-bit grayscale are distributed over 12 subfields. FIG. 5 shows an example of a 12-subfield sustain pulse distribution for an 8-bit grayscale, similar to that described in the '863 application.

Japanese Patent Application No. 08-311647 describes another distribution known as pulse width modulation (PWM) coding. FIG. 6 shows an example of a PWM 12-subfield sustain pulse distribution for an 8-bit grayscale. The example in FIG. 6 is similar to that in FIG. 5, but FIG. 6 relates to PWM and assigns different weights to the subfields.

Conventional video signals are gamma corrected to rectify non-linearities of color cathode ray tubes. However, PDPs do not exhibit such nonlinearities. Accordingly, in order to use a conventional video signal in a PDP system, an "inverse" gamma function must remove the gamma correction curve embedded in the conventional video signal and produce an output that matches the linearity of the PDP. The linear output data is represented in an 8-bit field that is sent to display logic circuitry for subfield processing.

The inverse gamma function applied to the gamma corrected input data is typically defined by the equation:

$$\text{Output_Data} = \text{Input_Range} \times \left(\frac{\text{Input_Code}}{\text{Input_Range}}\right)^{2.2} \quad (1)$$

FIG. 7 is a graph representing the gamma correction function (Curve B), the inverse gamma function (Curve C) and a desired linear output function (Curve A). Inverse-gamma correction greatly reduces the number of gradations represented on the display. While the linear response allows 256 different output values, the inverse-gamma curve allows only 184 different output values. This is most evident in the low-level image data where the input value must change considerably to achieve a small change in the output value. As the input value increases, the slope of the curve increases, so that at high input levels a small change of input produces a large change of brightness.

FIG. 8 is a graph of the gamma correction function for input values ranging from 0 to 40 counts of conventional video signal data. Note that, an input value of 15 is required before any change is produced at the output, and input values of 16 through 25 all produce-an output value of 1. Consequently, at low intensity levels, a viewer sees a set of wide contours, each consisting of a single value decoded from a larger number of input values.

A display controller for a PDP receives the gamma corrected input data, applies the inverse gamma function and enables individual subfields to produce a desired level of luminance. Since different types of digital displays produce different amounts of light and may have different brightness requirements, the amount of light produced varies. This requires use of a scaling operation to weight the subfields to yield full intensity. To preserve the linearity of the display, the subfields are binary coded, i.e., each subfield produces twice the light as the previous subfield, as described above. When the number of pulses in each subfield is scaled to meet a brightness requirement, the binary weighting is scaled. For example, to increase the brightness by 5 times, quantities of 5, 10, 20, 40, 80, 160, 320, and 640 sustain pulses are implemented in subfields 1 through 8, respectively.

These prior art techniques for managing the intensity of an image on a PDP suffer from several limitations. First, as low light level information is intensified, intensity contouring is visible when an image presents data that moves between low level intensities. Second, the gradual slope of the inverse-gamma function for low input values produces artifacts that are perceptible to the human eye. The human eye operates more logarithmically than linearly and consequently, it readily perceives a change in low light levels, making a viewer highly receptive to low level intensity transitions. Third, a moving picture disturbance (MPD) occurs as light shifts between subfields in a moving image. This causes the viewer to see false color contours as an image shifts across a display.

As discussed above, a pixel that is to be illuminated in a subfield is first activated by a write voltage applied to the electrodes that define the pixel. Nonetheless, the pixel is addressed and sustain pulses are generated regardless of whether the pixel is to be illuminated. The addressing of the pixel and the generation of sustain pulses in a subfield within which a pixel will not be illuminated is a waste of power.

It is an object of the present invention to provide a method and system for improving the image quality of a display in which a pixel is illuminated by pulses generated in subfields of a frame of the image in accordance with a pulse distribution function.

It is another object of the present invention to provide such a method and system that improves resolution at low intensity levels.

It is another object of the present invention to provide such a method and system that reduces moving picture disturbances.

It is yet another object of the present invention to provide such a method and system that reduces power applied to the display.

SUMMARY OF THE INVENTION

In accordance with a first method of the present invention, a method is provided for improving an image on a display that images pixels. Each of the pixels has an intensity represented by a respective pixel value, an intensity of a given pixel being associated with a number of pulses produced within a set of subfields in a frame-time, and the pulses allocated among the set of subfields in accordance with a pulse distribution. The method comprises the steps of determining a maximum pixel value to be imaged during the frame-time, and altering a number of pulses within a given subfield based on the maximum pixel value, thus modifying the pulse distribution.

In accordance with a second method of the present invention, a method is provided for reducing power consumed by a display that images pixels in which an intensity of a given pixel is associated with a number of pulses produced within a set of subfields in a frame-time. The method comprises the step of reducing power to the display during a given subfield in which none of the pulses are applied to produce the intensity of the given pixel.

The invention takes advantage of subfields that would not ordinarily be used to produce the desired level of luminance. The maximum pixel value is compared to a threshold that correlates to a sustain pulse distribution boundary of a subfield. The threshold is related to a number of pulses allocated to subfields prior in time in a frame-time. In the preferred embodiment, the invention identifies the subfield having the smallest associated threshold that is also greater than the maximum pixel value. When the maximum pixel value is less than a threshold, subfields occurring after that threshold can be used for the production of new pulses or for a redistribution of existing pulses. Also, an unused subfield can provide a period of time during which power to the display can be reduced.

BRIEF DESCRIPTION OF THE DRAWINGS

Please note that the drawings are not necessarily to scale. FIGS. 4–6, 9–11, 13–17, 21–27, and 29–34 are graphs on which the vertical axes indicate relative distributions of sustain pulses within subfields in a frame. The horizontal axes of these figures are not intended to illustrate the relative durations of the subfields.

DETAILED DESCRIPTION OF THE INVENTION

The present invention is a method and system for improving the image quality of a display in which a pixel is illuminated by pulses generated in subfields of a frame of the image in accordance with a pulse distribution function. In brief, input data is frame-buffered and evaluated to determine a maximum pixel value in the frame. Thereafter, a number of pulses within a subfield is altered based on the maximum pixel value, thus the sustain pulse distribution is modified. The invention is particularly suited for use with PDPs.

The modification of the sustain pulse distribution is possible because the invention takes advantage of subfields that would not ordinarily be used to produce the desired level of luminance. The maximum pixel value is compared to a threshold that correlates to a sustain pulse distribution boundary of a subfield. The threshold is related to a number of pulses allocated to subfields prior in time in a frame-time.

In the preferred embodiment, the invention identifies the subfield having the smallest associated threshold that is also greater than the maximum pixel value. When the maximum pixel value is less than a threshold, subfields occurring after that threshold can be used for the production of new pulses or for a redistribution of existing pulses. Also, an unused subfield can provide a period of time during which power-to the display can be reduced.

Figure 1:
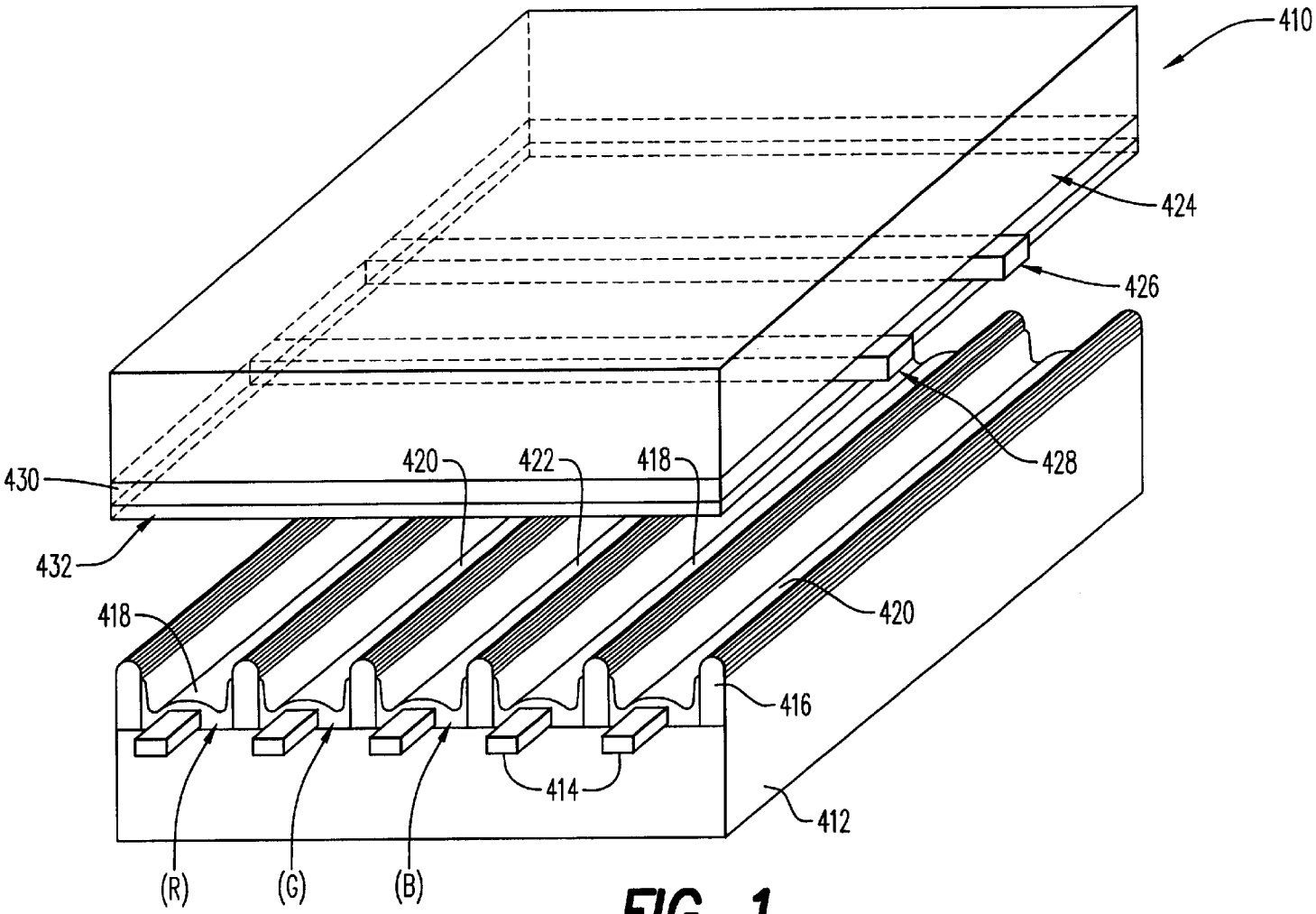
FIG. 1 (PRIOR ART)
FIG. 1 is a perspective view of a prior art PDP configuration.
Figure 2:
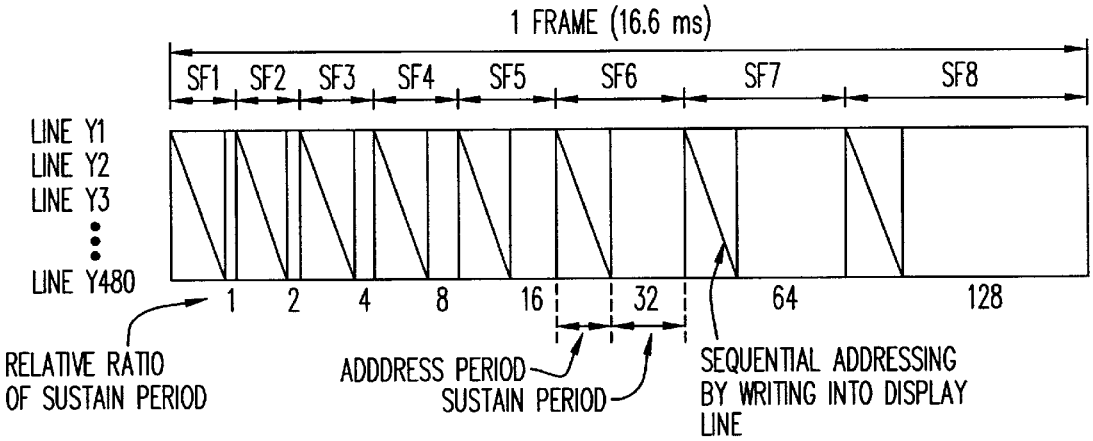
FIG. 2 (PRIOR ART)
FIG. 2 is a schematic view of a frame time and the subfields included therein.
Figure 3:
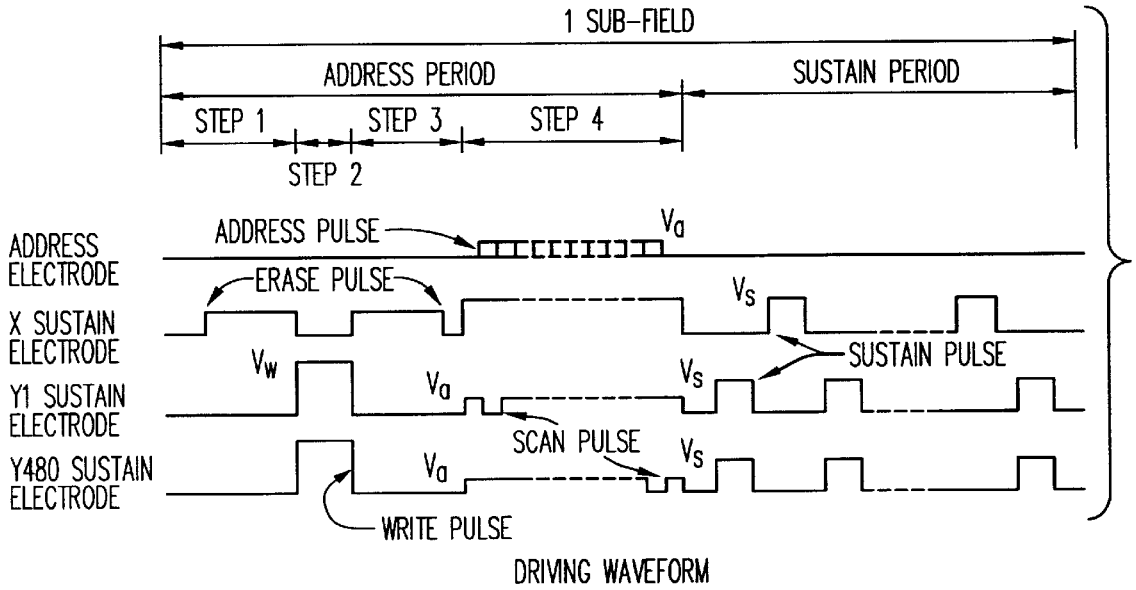
FIG. 3 (PRIOR ART)
FIG. 3 illustrates the signals present in a single subfield.
Figure 4:
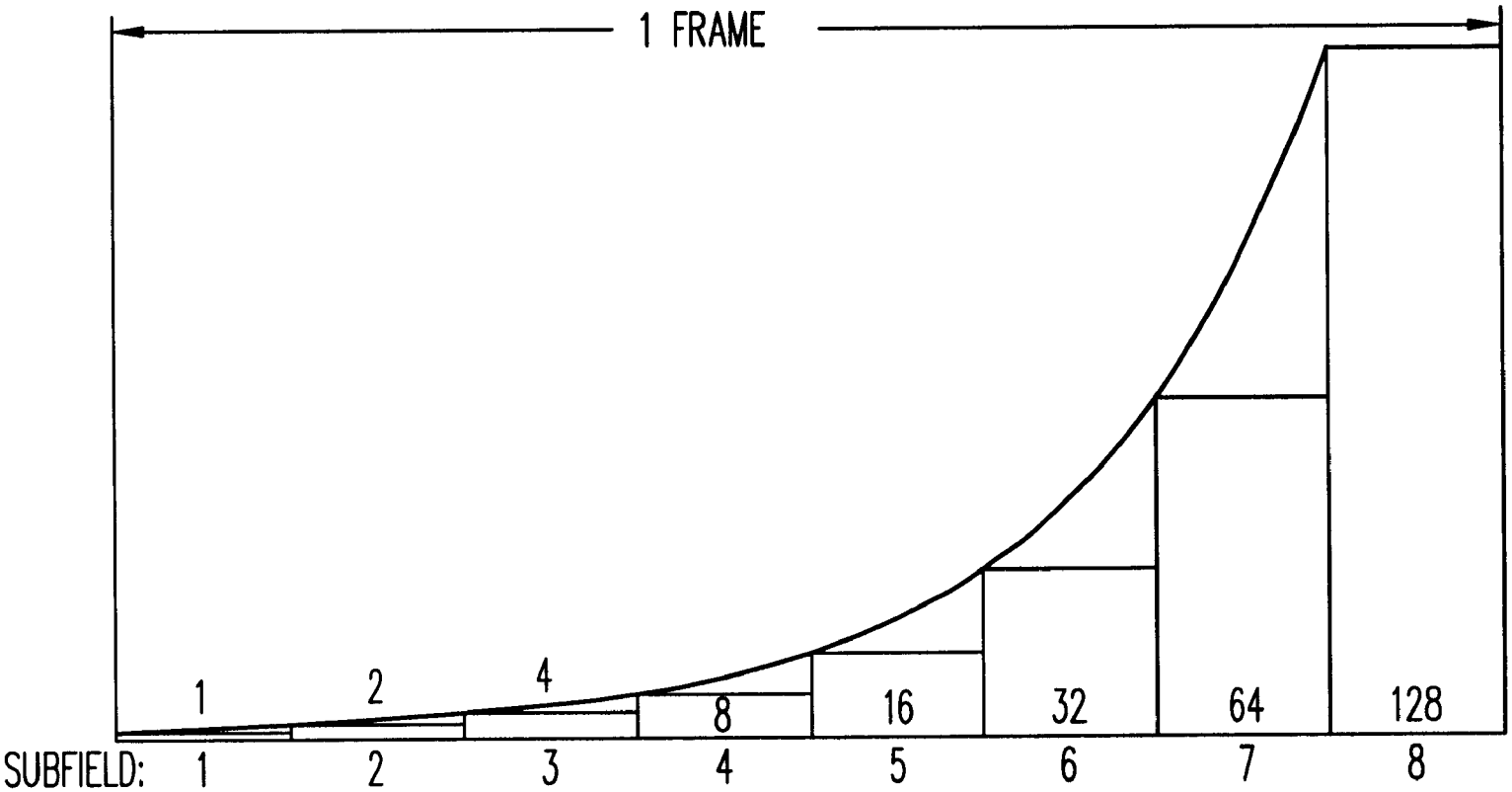
FIG. 4 (PRIOR ART)
FIG. 4 illustrates a standard sustain pulse distribution over 8 subfields for an 8-bit grayscale system.
Figure 5:
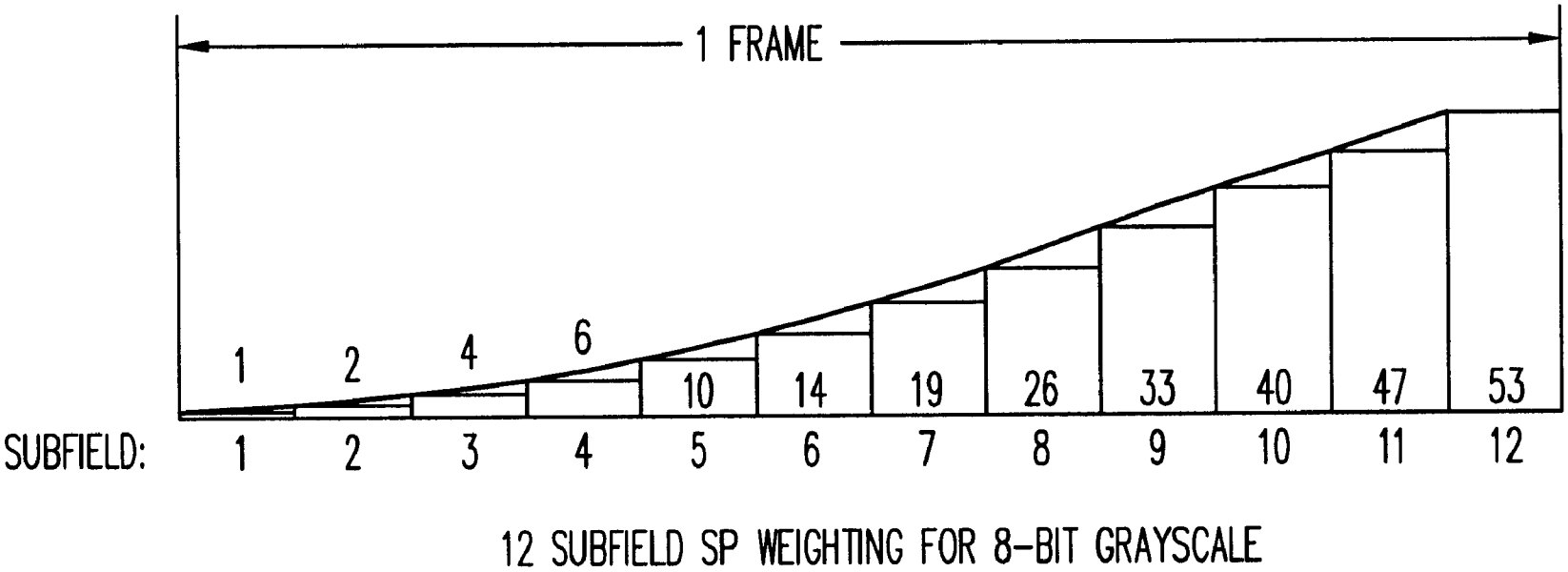
FIG. 5 (PRIOR ART)
FIG. 5 illustrates a 12-subfield sustain pulse distribution for an 8-bit grayscale system.
Figure 6:
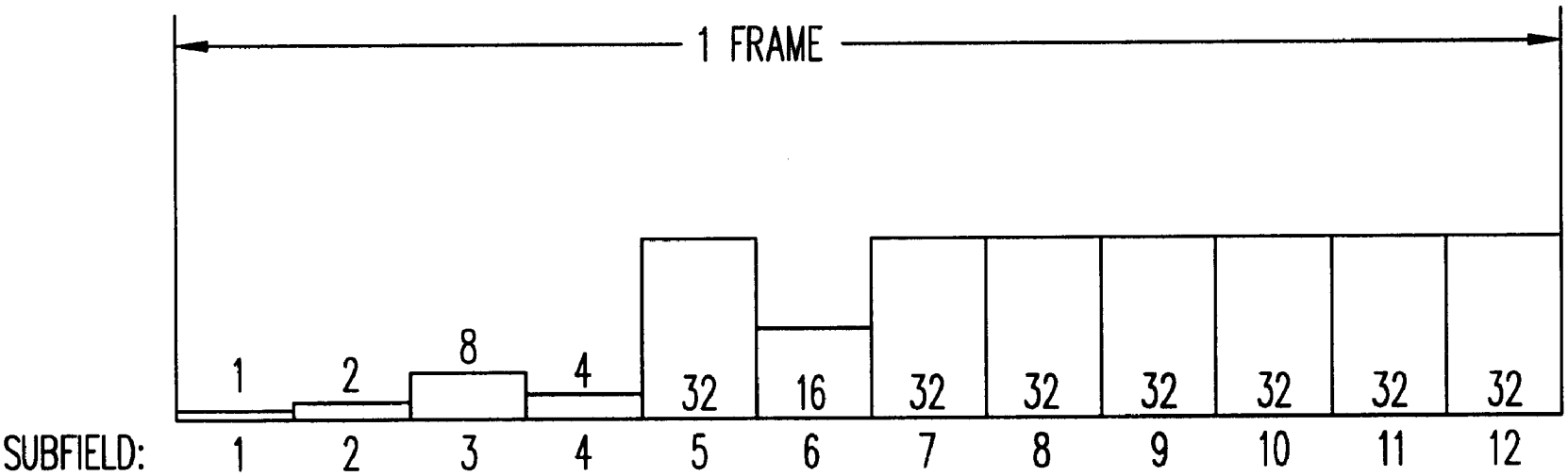
FIG. 6 (PRIOR ART)
FIG. 6 illustrates a pulse width modulated 12-subfield sustain pulse distribution for an 8-bit grayscale system.
Figure 7:
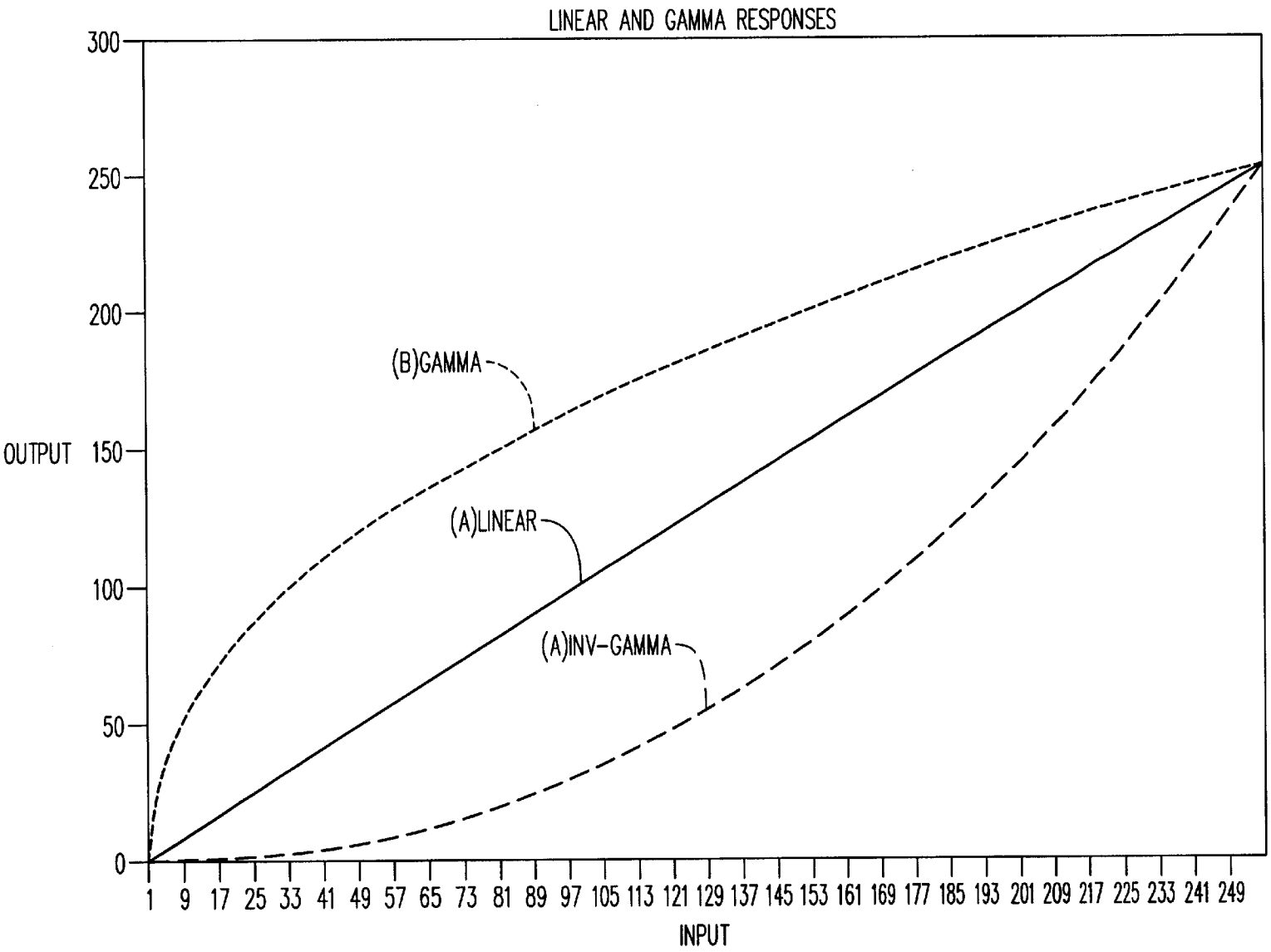
FIG. 7 (PRIOR ART)
FIG. 7 is a graph of a gamma correction function, an inverse gamma function and a linear output function.
Figure 8:
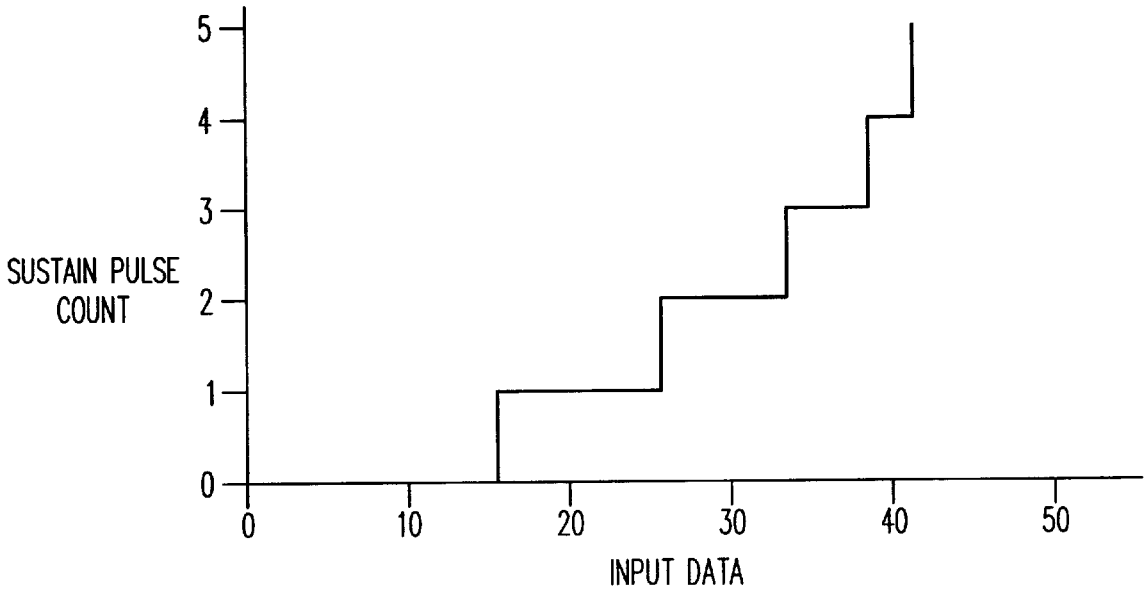
FIG. 8 (PRIOR ART)
FIG. 8 is a graph of a gamma correction function for input values ranging from 0 to 40 counts of conventional video signal data.
Figure 9:
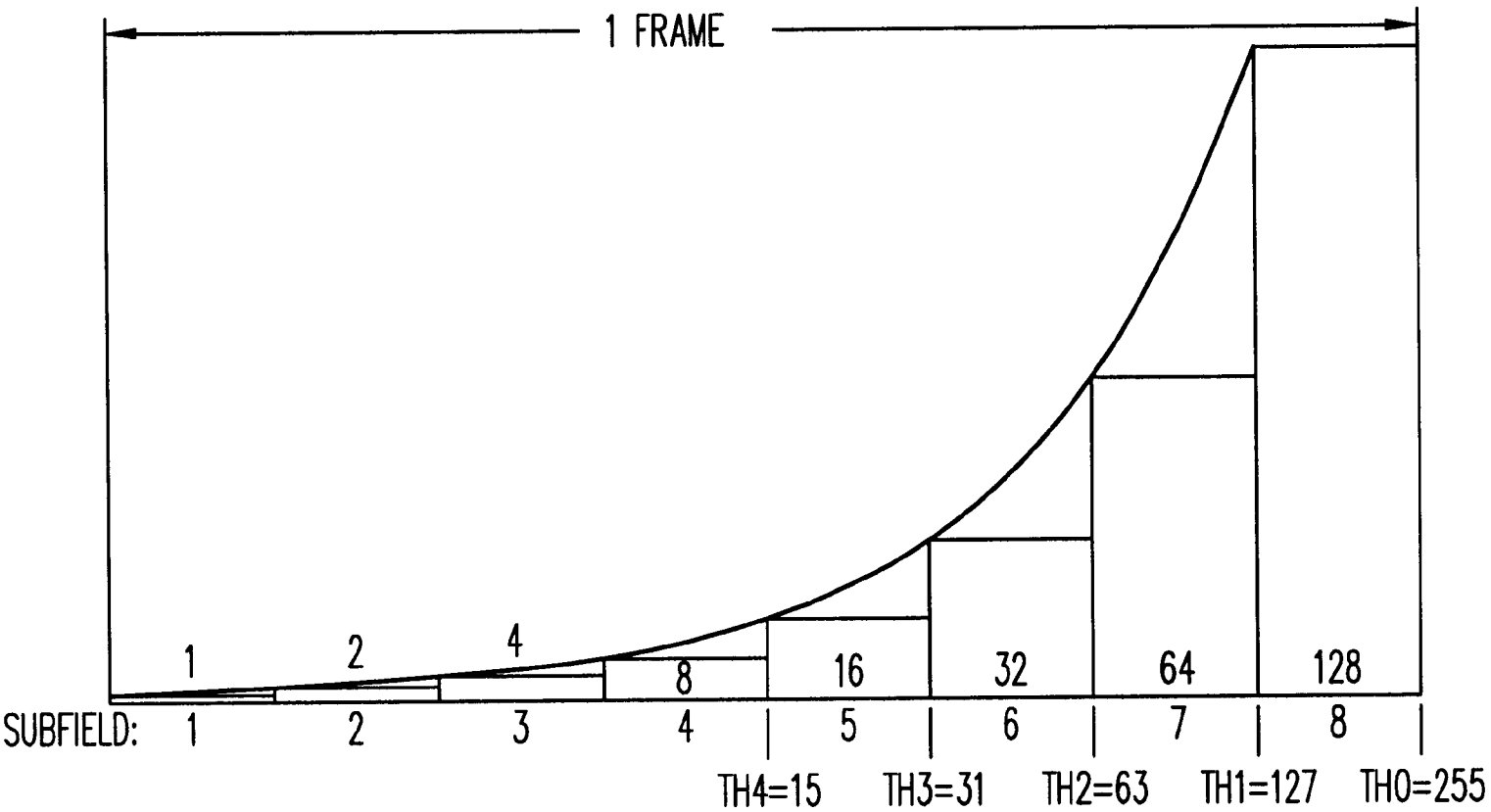
FIG. 9 illustrates an 8-subfield sustain pulse distribution for an 8-bit grayscale system with thresholds in accordance with the present invention.

FIG. 9 shows an 8-subfield sustain pulse distribution for an 8-bit grayscale system. Five thresholds are indicated, i.e., TH0=255, TH1=127, TH2=63, TH3=31 and TH4=15. Consider a case of a maximum pixel value of 185 in a frame. The maximum pixel value of 185 is greater than all of the thresholds except for TH0=255. Consequently, all of the subfields must be used to produce sustain pulses to provide a level of intensity corresponding to a pixel value of 185. Now consider a case of a maximum pixel value of 90. The maximum pixel value of 90 is less than TH1=127, but greater than TH2=63. Thus, subfield 8 is not required to produce sustain pulses to provide a level of intensity corresponding to a pixel value of 90.

Figure 10:
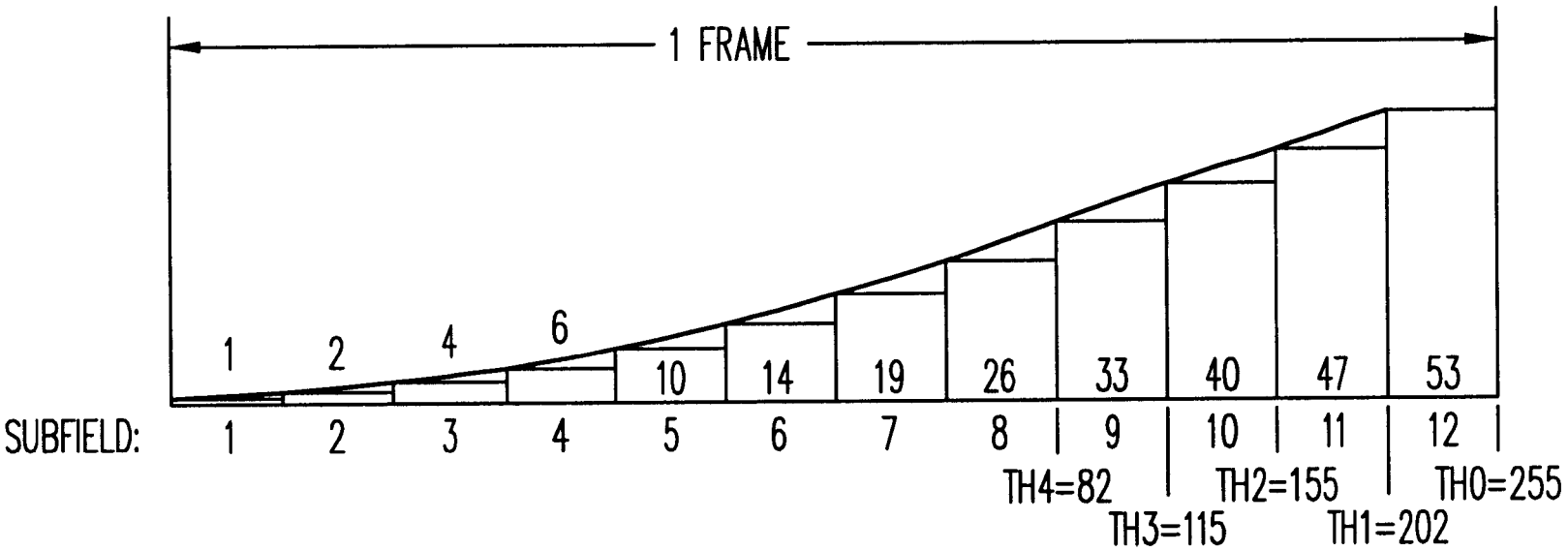
FIG. 10 illustrates a 12-subfield sustain pulse distribution for an 8-bit grayscale system with thresholds in accordance with the present invention.

FIG. 10 shows a 12-subfield sustain pulse distribution for an 8-bit grayscale system. Five thresholds are indicated, i.e., TH0=255, TH1=202, TH2=155, TH3=115, TH4=82. Note that each of these thresholds is a greater value than that of the corresponding thresholds, TH0–TH4, shown in FIG. 9. A maximum pixel value of 185. is less than TH 1=202, but greater than TH2=155. Consequently, subfield 12 is not required to produce sustain pulses for a level of light intensity corresponding to a pixel value of 185. A maximum pixel value of 90 is less than TH3=115, but greater than TH4=82. Thus, subfields 10, 11 and 12 are not required to produce sustain pulses for a level of intensity corresponding to a pixel value of 90.

The invention takes advantage of unused subfields by using them for the production of new pulses or for a redistribution of existing pulses. When comparing, the examples above in the discussion of FIGS. 9 and 10, one finds that the 12-subfield sustain pulse distribution (FIG. 10) provides more opportunity for utilizing otherwise unused subfields than does the 8-subfield sustain pulse distribution (FIG. 9). Accordingly, the present invention can be applied more frequently in a 12-subfield system than in an 8-subfield system.

Figure 11:
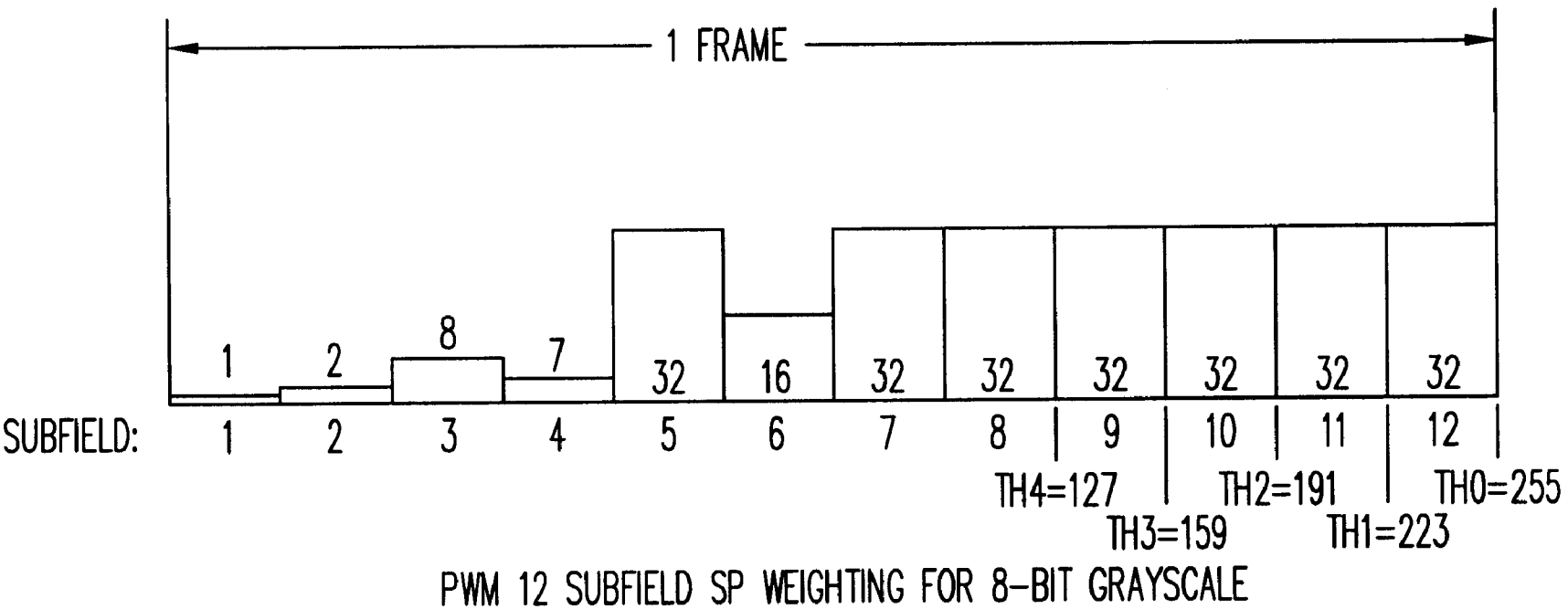
FIG. 11 illustrates a pulse width modulation 12-subfield sustain pulse distribution for an 8-bit grayscale system with thresholds in accordance with the present invention.

FIG. 11 shows a pulse width modulation (PWM) 12-subfield sustain pulse distribution for an 8-bit grayscale system. The example in FIG. 11 is similar to that in FIG. 10, but FIG. 11 relates to PWM and assigns different weights to the subfields. Five thresholds are indicated, i.e., TH0=255, TH1=223, TH2=191, TH3=159 and TH4=127. Each of these thresholds is a greater value than that of the corresponding thresholds, TH0–TH4, shown in FIG. 10. The present invention can therefore be applied more frequently with the PWM 12-subfield sustain pulse distribution (FIG. 11) than with the 12-subfield sustain pulse distribution (FIG. 10). However, tests have indicated that the distribution of FIG. 10 provides superior performance regarding a reduction of MPD artifacts. Therefore, the 12-subfield sustain pulse distribution of FIG. 10 is a preferred distribution, and it shall be assumed in the examples subsequently described herein.

The examples presented herein assume an 8-bit pixel value and a 12-subfield sustain pulse distribution. They also assume a display capable of generating at least 255 sustain pulses per frame. However, the invention is not constrained to these examples. In general terms, the present invention can be applied to a system having an N-bit pixel value, and a display capable of producing $P(2^N-1)$ sustain pulses in a frame, where P is an integer greater than 0, and the number of subfields is greater than or equal to N.

Although the examples presented herein show a sequence of subfields having an least significant bit (LSB) in subfield 1 and a most significant bit (MSB) in subfield 12, the present invention can be applied to any sequence of subfields. For example, the sequence can be ordered in time from MSB to LSB, or it can be independent of an LSB-MSB ordering, such as the distribution 1, 4, 10, 19, 33, 47, 53, 40, 26, 14 6, and 2 sustain pulses.

The present invention includes three modes of operation, for convenience referred to as Mode 1, Mode 2 and Mode 3 that may be used separately or in conjunction with each other. In Mode 1, low-level resolution is improved by allocating one or more new pulses to an otherwise unused subfield. In Mode 2, MPD reduction is achieved by redistributing pulses from subfields below the threshold, and including the otherwise unused subfield in the redistribution. In Mode 3, driving circuits for the display are turned OFF during unused subfields.

In Mode 1, low-level resolution is improved by allocating one or-more new pulses to an otherwise unused subfield. When a display is capable of producing more than 255 sustain pulses in a frame, more grayscale gradations can be realized. The present invention can thus use an 8-bit grayscale input value to produce a pseudo grayscale value of greater than 8 bits. Table 1 lists the minimum number of sustain pulses that a system must be capable of producing to support various pseudo grayscaling schemes. For example, for a 12-bit pseudo grayscale, the system must be capable of producing at least 4080 sustain pulses per frame. The table also shows an allocation of pulses, and indicates the threshold levels that can possibly be realized in a system capable of providing a 12-subfield sustain pulse distribution such as that shown in FIG. 10.

TABLE 1

Minimum Number Of Sustain Pulses Required For 8–12 Bit Grayscale Systems

| Grayscale System | SF1 | SF2 | SF3 | SF4 | SF5 | SF6 | SF7 | SF8 | SF9 | SF10 | SF11 | SF12 | Sustain Pulses | Possible Thresholds |
|---|---|---|---|---|---|---|---|---|---|---|---|---|---|---|
| 8-bit | 1 | 2 | 4 | 6 | 10 | 14 | 19 | 26 | 33 | 40 | 47 | 53 | 255 | 0 |
| 9-bit | 2 | 4 | 8 | 12 | 20 | 28 | 38 | 52 | 66 | 80 | 94 | 106 | 510 | 0,1 |
| 10-bit | 4 | 8 | 16 | 24 | 40 | 56 | 76 | 104 | 132 | 160 | 188 | 212 | 1020 | 0,1,2 |
| 11-bit | 8 | 16 | 32 | 48 | 80 | 112 | 152 | 208 | 264 | 320 | 376 | 424 | 2040 | 0,1,2,3 |
| 12-bit | 16 | 32 | 64 | 96 | 160 | 224 | 304 | 416 | 528 | 640 | 752 | 848 | 4080 | 0,1,2,3,4 |

Figure 12:
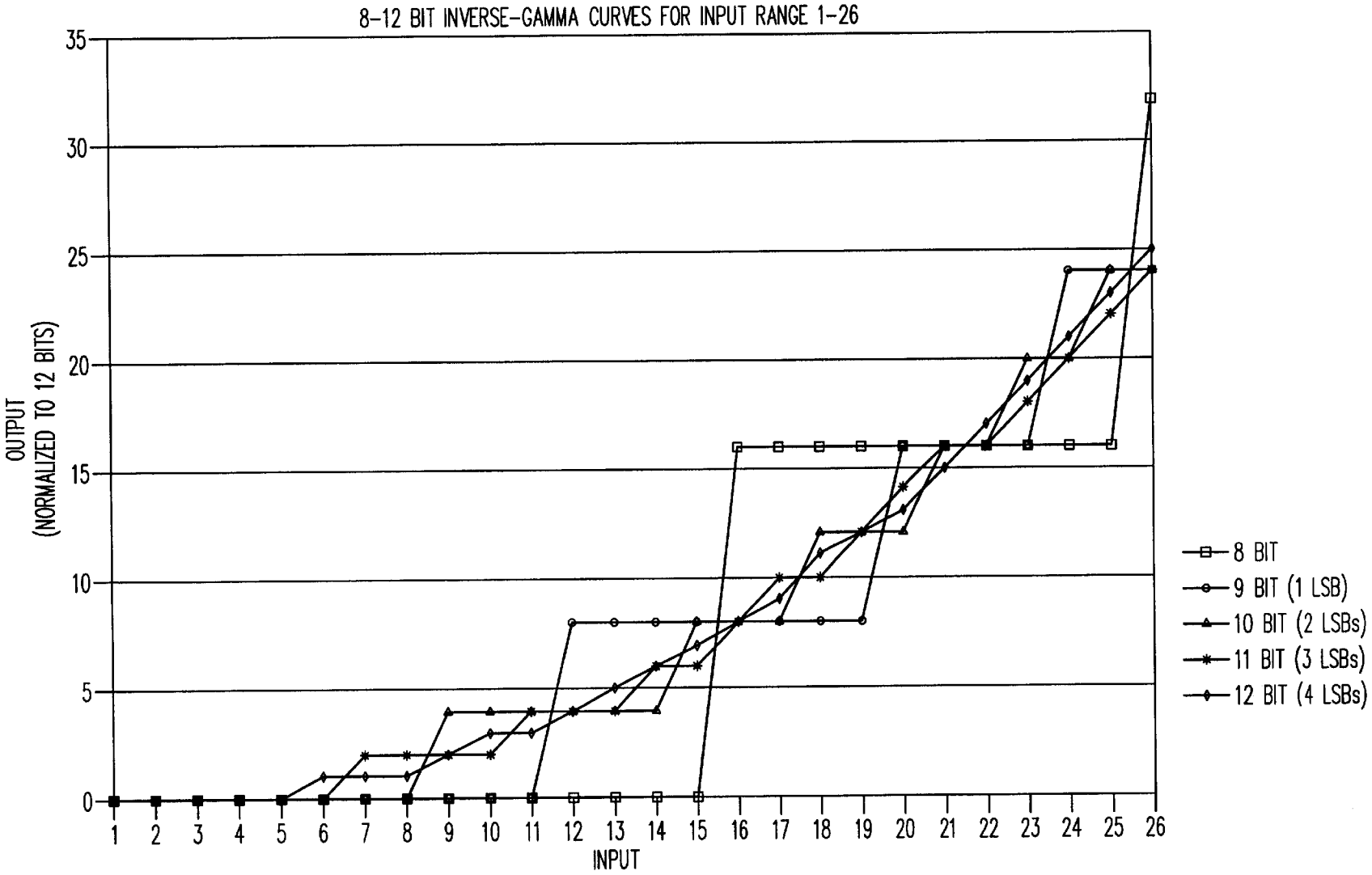
FIG. 12 is a graph of pseudo 9–12 grayscaling that can be realized for a low value input to an inverse gamma function in accordance with the present invention.

FIG. 12 shows the benefit of pseudo 9–12 grayscaling that can be realized for a low value input to the inverse gamma function. For low level inputs in the range of 0–26, an 8-bit grayscale produces only three different output values, i.e., 0, 16 and 32, while a 12-bit grayscale yields 19 different output values. 12-bit grayscaling offers increased resolution over 9-bit grayscaling.

Given a display capable of producing 4080 sustain pulses per frame, in an 8-bit grayscale system a least significant bit (LSB) represents 16 sustain pulses. The present invention produces a pseudo 9–12 bit grayscale by taking advantage of subfields that are not ordinarily used in the 8-bit grayscale system and allocating new LSBs representing 8, 4, 2 and 1 pulses. With 4080 sustain pulses per frame, the present invention can produce a pseudo 12-bit grayscale (see Table 1). The following examples further illustrate the operation of Mode 1, and the technique of pseudo 9–12 bit grayscaling.

Figure 13:
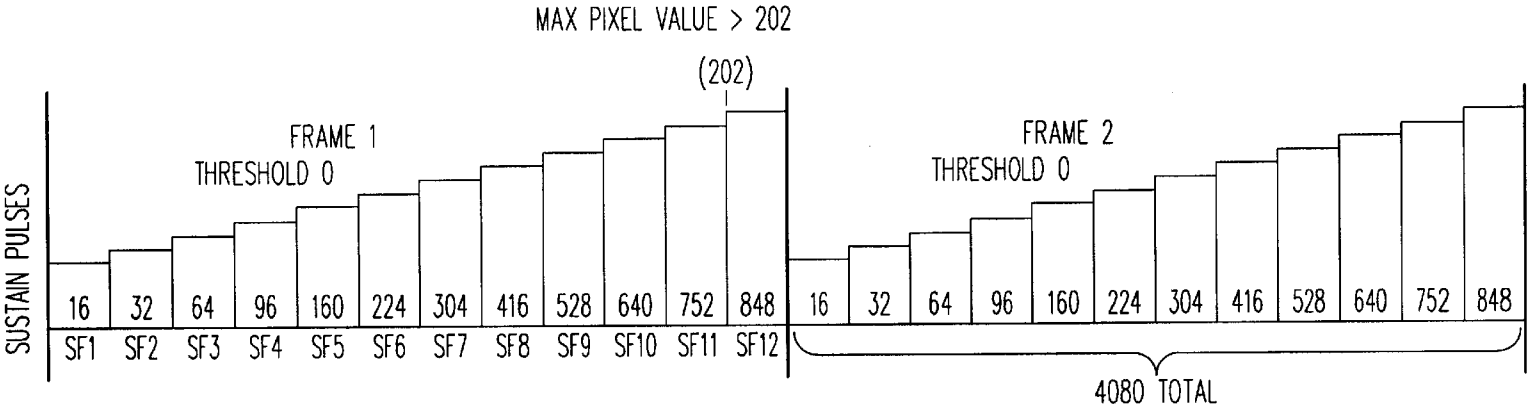
FIGS. 13–17 illustrate a technique for allocating pulses to subfields to define sustain pulse distributions over 12 subfields in accordance with the present invention.

Mode 1, Threshold 0. Refer to FIG. 13. The maximum pixel value is greater than TH1=202. All twelve subfields are used, and therefore none are available for pseudo grayscaling.

Figure 14:
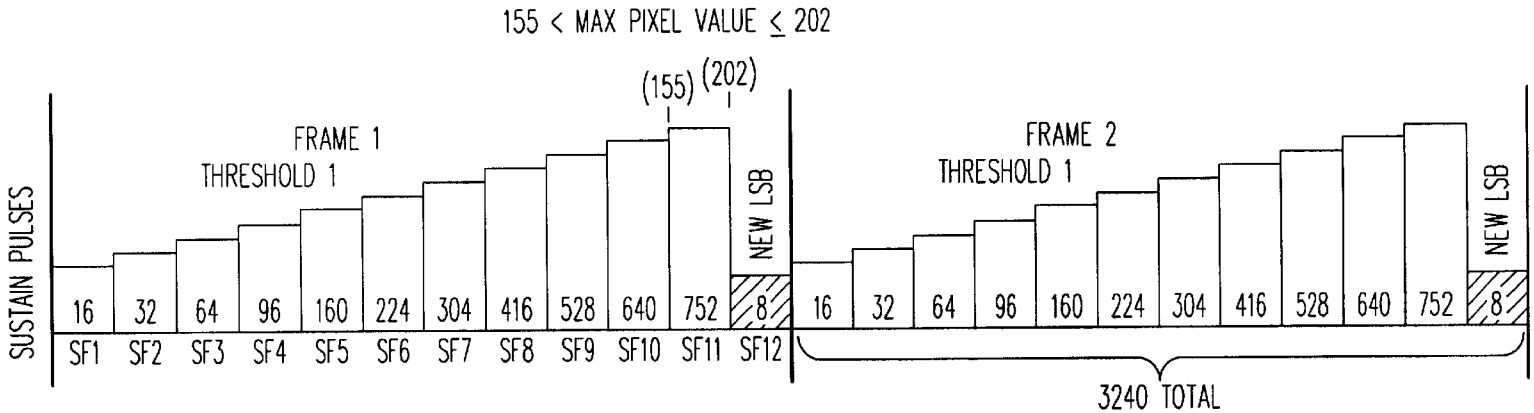

Mode 1, Threshold 1. Refer to FIG. 14. The maximum pixel value is less than or equal to TH1=202, and greater than TH2=155. Subfield 12 is not ordinarily used. Subfield 12 can therefore be used for one new LSB representing 8 sustain pulses. Pseudo 9-bit grayscaling is thus achieved.

Figure 15:
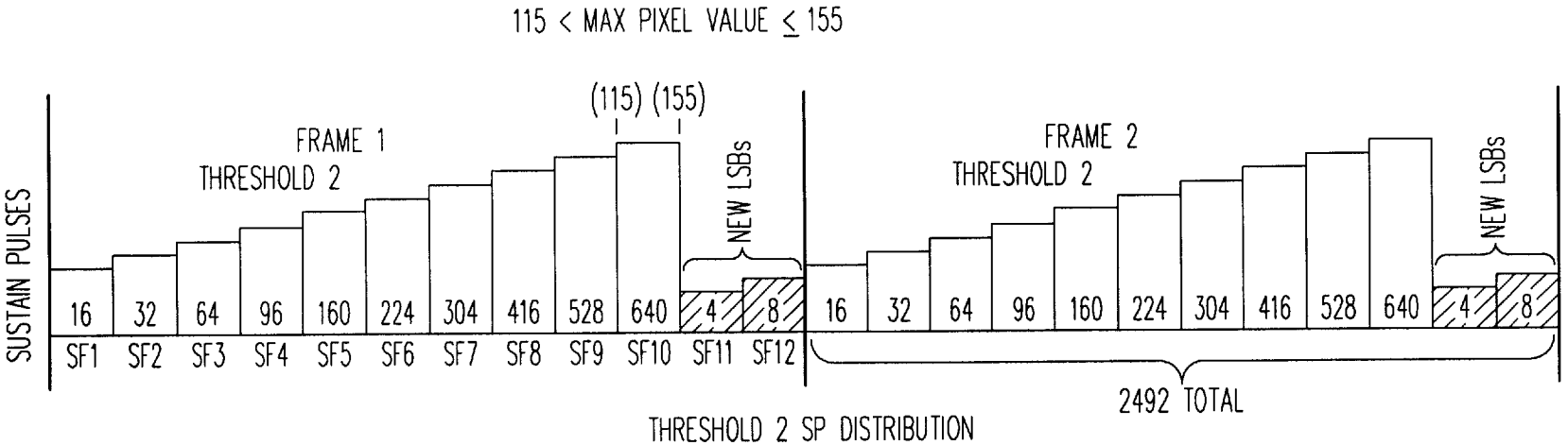

Mode 1, Threshold 2. Refer to FIG. 15. The maximum pixel value is less than or equal to TH2=155, and greater than TH3=115. Subfields 12 and 11 are not ordinarily used. Subfields 12 and 11 can therefore be used for two new LSBs representing 8 and 4 sustain pulses. Pseudo 10-bit grayscaling is thus achieved.

Figure 16:
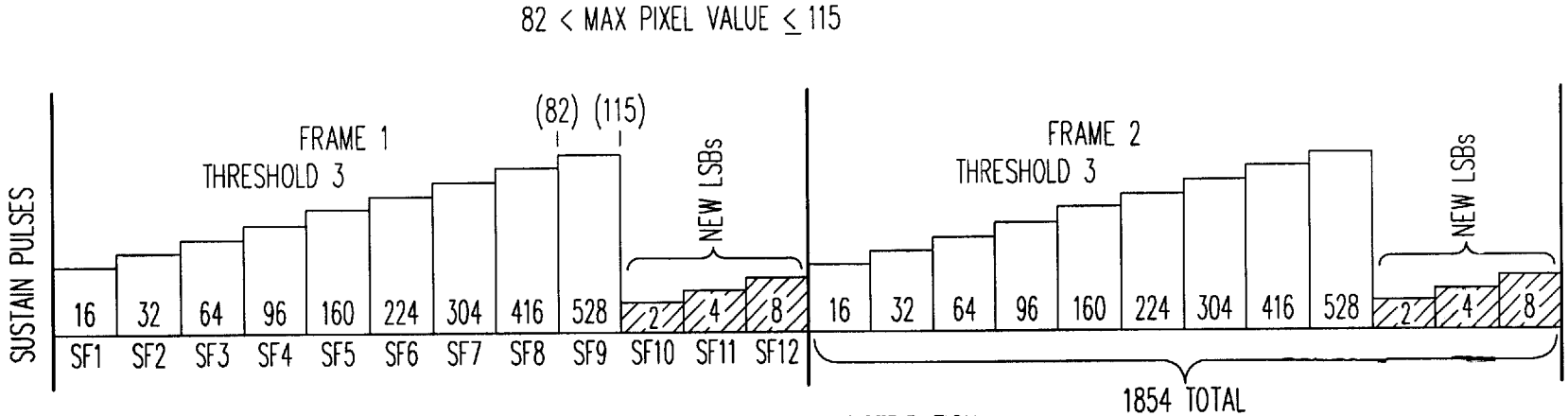

Mode 1, Threshold 3. Refer to FIG. 16. The maximum pixel value is less than or equal to TH3=115, and greater than TH4=82. Subfields 12, 11 and 10 are not ordinarily used. Subfields 12, 11 and 10 can therefore be used for three new LSBs representing 8, 4 and 2 sustain pulses. Pseudo 11-bit grayscaling is thus achieved.

Figure 17:
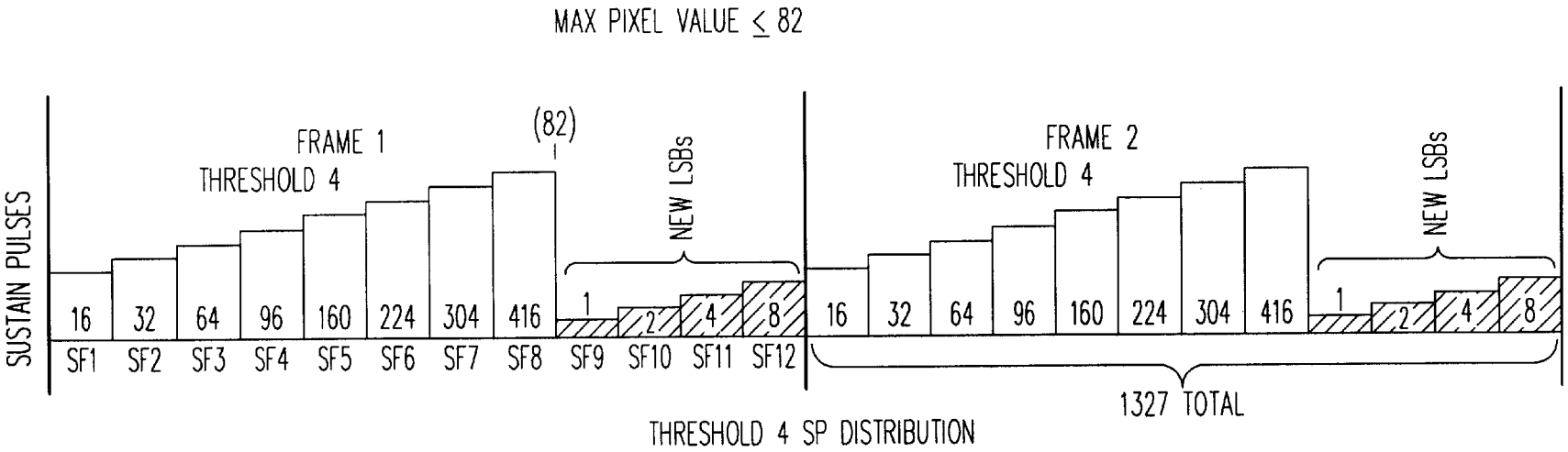

Mode 1, Threshold 4. Refer to FIG. 17. The maximum pixel value is less than or equal to TH4=82. Subfields 12, 11, 10 and 9 are not ordinarily used. Subfields 12, 11, 10 and 9 can therefore be used for four new LSBs representing 8, 4, 2 and 1 sustain pulses. Pseudo 12-bit grayscaling is thus achieved.

In a general case, Mode 1 of the present invention recognizes that some subfield in the pulse distribution contains a least significant number of pulses. The invention identifies an unused subfield and allocates to the unused subfield a quantity of new pulses equal to one half of the least significant number.

The relative placement of sustain pulses within a frame also influences the quality of an image as perceived by a viewer. This is because the human eye interprets an image by integrating the pulses, and the eye is susceptible to frame-to-frame variations in the pulse distribution.

Figure 18:
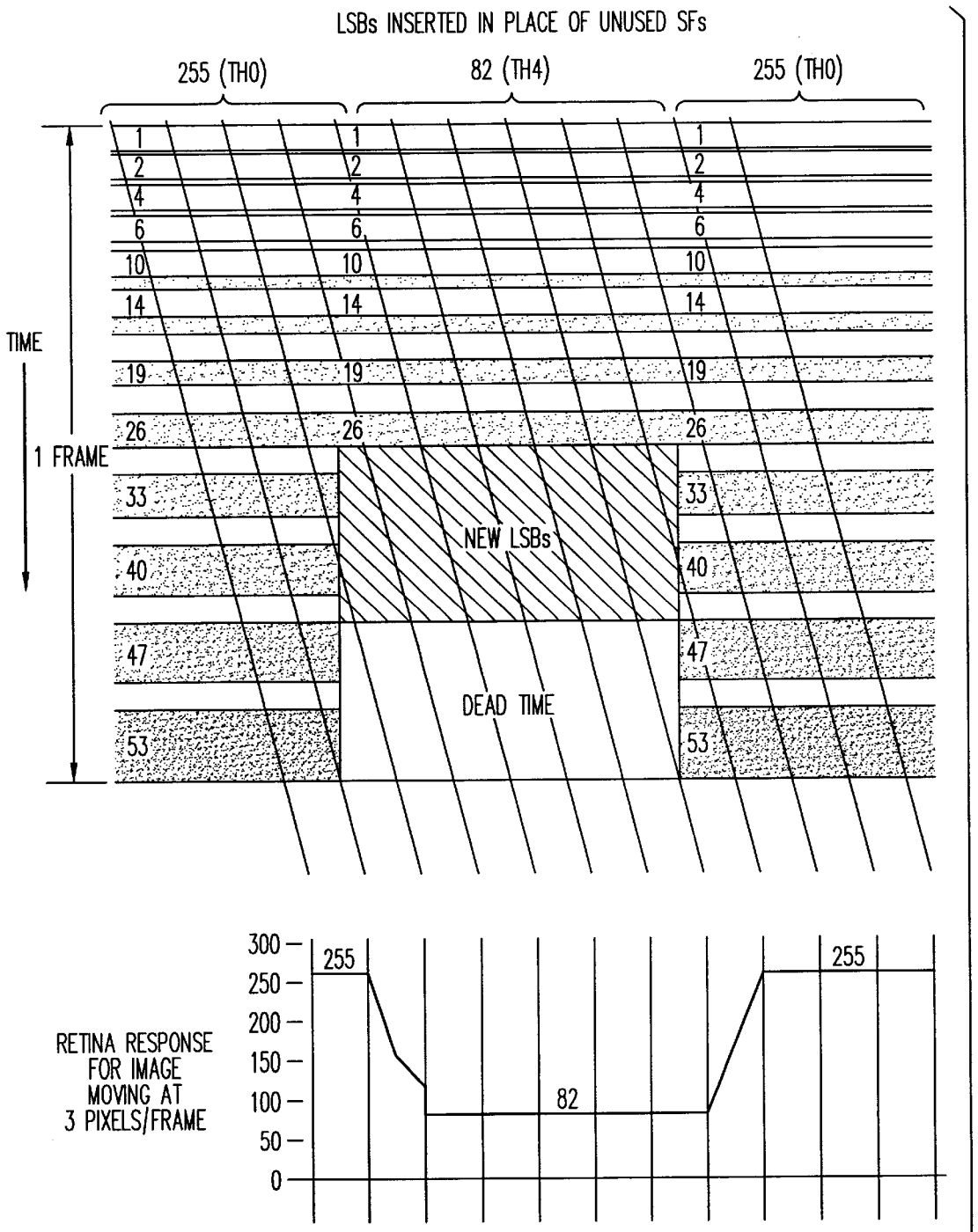
FIG. 18 illustrates subfields with new least significant bits (LSBs) situated in place of formerly unused subfields in accordance with the present invention.
Figure 19:
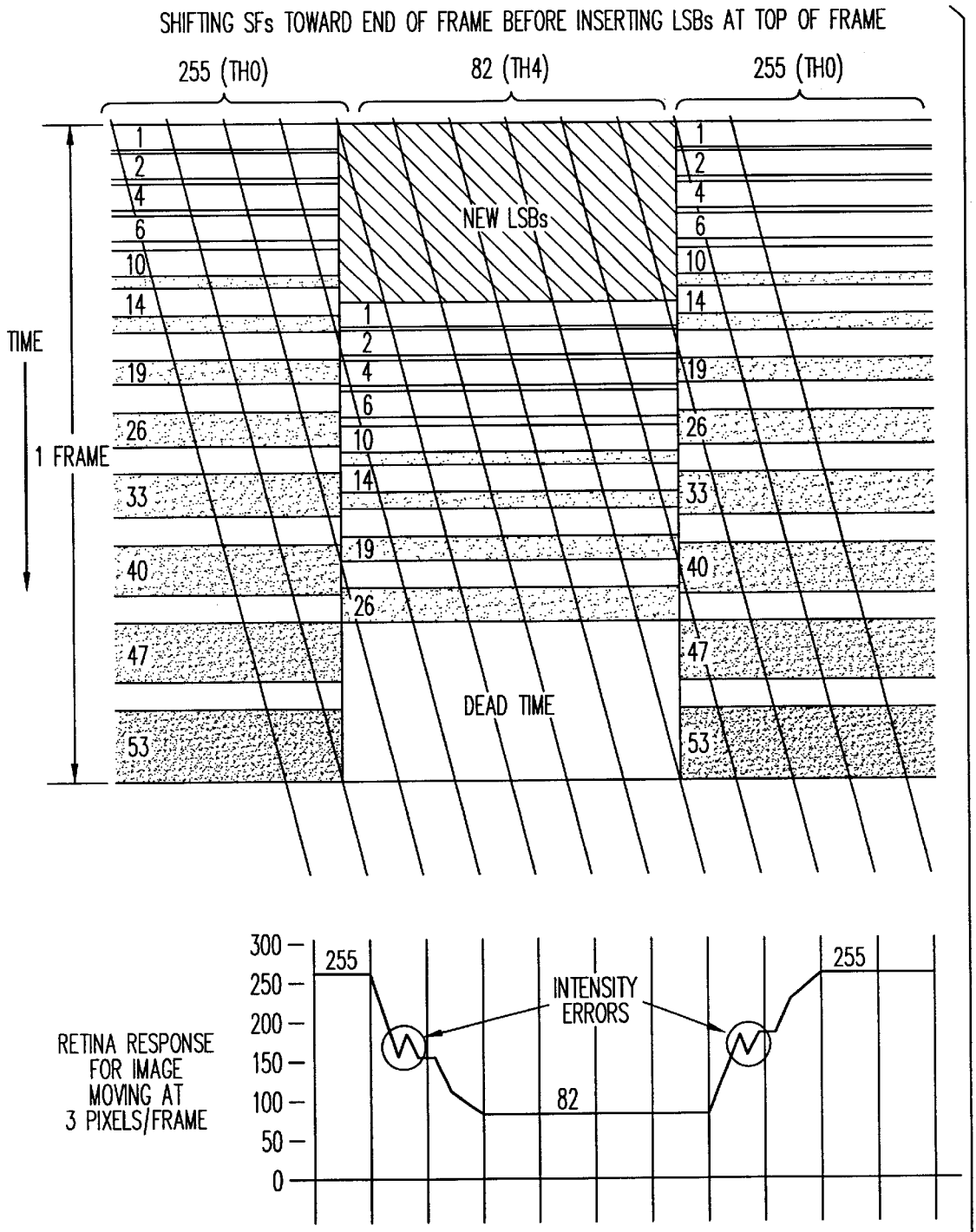
FIG. 19 illustrates subfields with new LSBs situated at the top of a frame in accordance with the present invention.

FIGS. 18 and 19 show two possible schemes for the placement of new pulses with a frame of image data. The figures also depict a retina response to excursions between Threshold 0 and Threshold 4 with an image moving at three pixels per frame. The new pulses can be situated at any point within the frame, and the ordering of the subfields can also be modified. FIG. 18 shows the subfields with new LSBs situated in place of the formerly unused subfields while FIG. 19 shows the subfields with new LSBs situated at the top of the frame. Although either scheme can be used, the arrangement shown in FIG. 19 can introduce 30 Hz flicker and MPD artifacts when several thresholds are crossed in consecutive frames. These artifacts can be introduced by overshoot and undershoot intensity errors in the retina response (see FIG. 19) caused by a temporal change in the position of subfields 1–8 within the frame. Accordingly, the arrangement shown in FIG. 18 is preferred over that of FIG. 19.

Dead time is a time during which no pulse is generated. An additional improvement can be realized by accumulating dead time and situating the new pulses at a predetermined position within the frame with respect to the dead time. Similarly, the new pulses can be situated so that the dead time resides at a predetermined position in the frame. The subfields that are designated for new sustain pulses ordinarily generate a major portion of the number of pulses within the frame. Since the quantity of pulses, typically 8, 4, 2 or 1, that are allocated to these subfields is much less than the quantity that the subfields are capable of accommodating, these subfields may contain substantial amounts of dead time.

Figure 20:
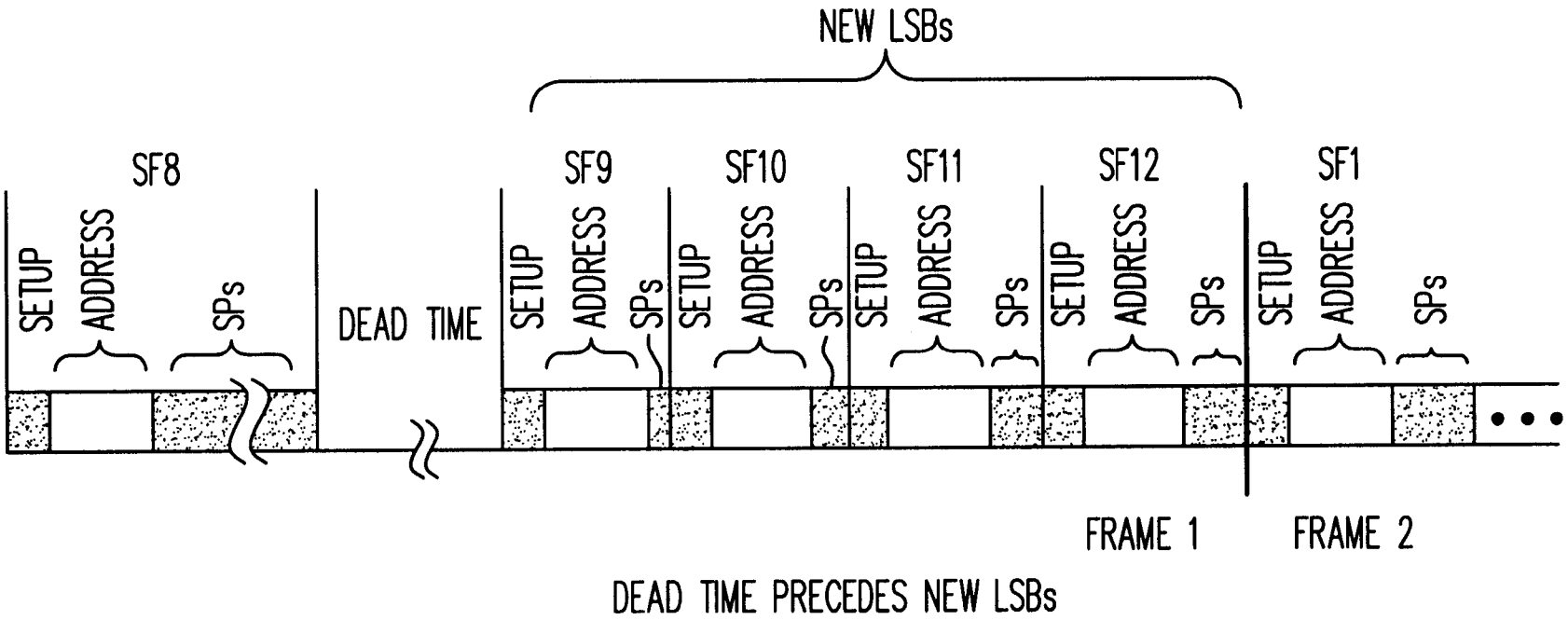
FIG. 20 illustrates a preferred arrangement in which new pulses are situated after accumulated dead time in accordance with the present invention.

FIG. 20 illustrates a preferred arrangement in which new pulses are situated after the accumulated dead time. Under this arrangement the new pulses will immediately precede the first subfield in the following frame. Consequently, light from the new pulses will transition smoothly into the next frame. Nonetheless, the invention is not limited to this arrangement, and the new pulses can be situated at any point within the frame with respect to the dead time. Furthermore, the dead time can be partitioned or redistributed throughout the frame.

Some PDP systems are capable of generating sustain pulses that provide varying levels of illumination. For example, a sustain pulse having a narrow pulse width may produce less light than a sustain pulse having a wider pulse width. Also, the light emitted during addressing can be considered to be some fraction of the light emitted by one sustain pulse. In such systems, ½ and ¼ brightness, and other fractional levels of brightness, can allow for increased grayscaling levels without increasing the number of sustain pulses.

Figure 21:
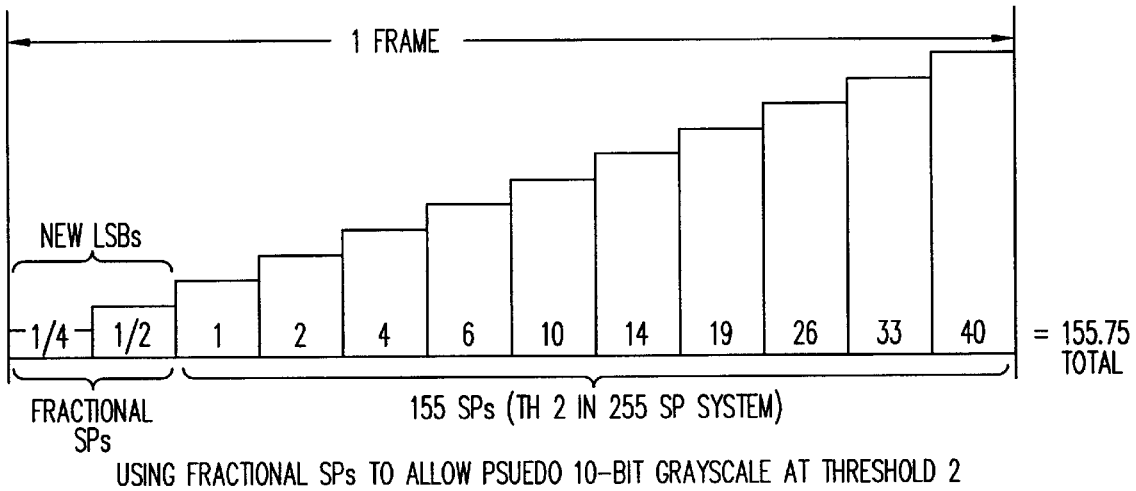
FIGS. 21 and 22 illustrate sustain pulse distributions over 12 subfields, including fractional sustain pulses in accordance with the present invention.
Figure 22:
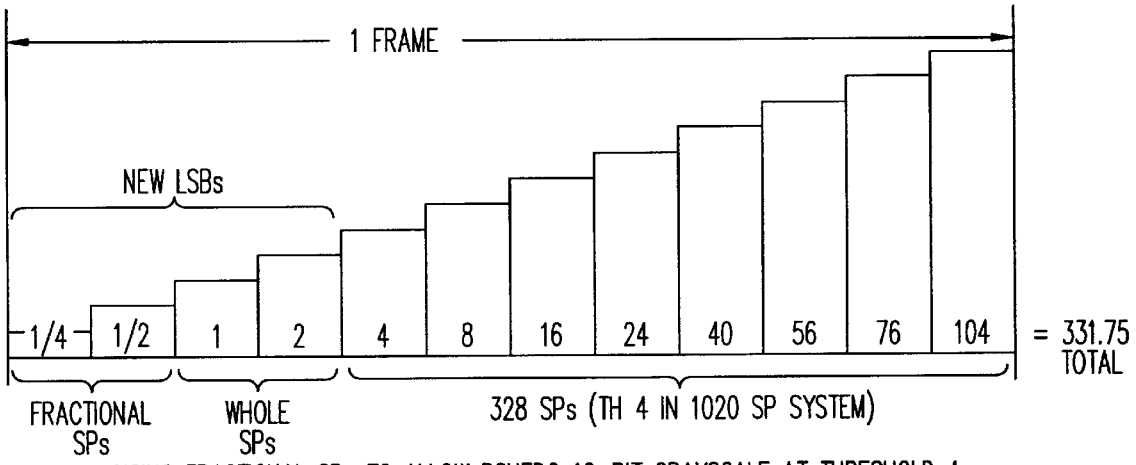

For example, as shown in FIG. 21, 10-bit grayscaling can be realized by adding a ½ sustain pulse and a ¼ sustain pulse to the 155 sustain pulses that are remaining at Threshold 2 for a total sustain pulse count of 155+½+¼=155.75 sustain pulses. As shown in FIG. 22, if a system is capable of producing 1020 sustain pulses, 10-bit grayscaling can be generated using whole sustain pulses (see Table 1). In an 8-bit system, TH4=82, while in a 10-bit system, TH4=328 (i.e., $328=2^2\times82$). Accordingly, when a maximum pixel values falls below 82 counts, 12-bit grayscaling can thus be achieved by adding LSBs representing ½ and ¼ fractional sustain pulses for a total sustain pulse count of 328+2+1+½+¼=331.75 sustain pulses. Therefore, low-level resolution can be improved by providing sustain pulses that yield less luminance than that of a regular sustain pulse.

In Mode 2, MPD reduction is achieved by redistributing pulses from subfields below the threshold into one or more subfields that are otherwise unused. That is, one or more pulses from the subfields below the threshold are allocated to one or more of the otherwise unused subfields. The MPD reduction is achieved by reducing variations in the level of light emitted in consecutive frames so that the retina response does not integrate false contours during motion in the image. As discussed above in the context of FIGS. 9 and 10, the advantage of using 12 subfields to represent an 8-bit pixel value is that the sustain pulses can be more linearly distributed across the subfields in a 12-subfield system than in an 8-subfield system. Reducing a delta sustain pulse count between adjacent subfields yields a reduction in MPD.

When one or more of the most significant subfields are not utilized in a frame, it is possible to redistribute the sustain pulses therefrom over all 12 subfields, further reducing the variation in number of sustain pulses between adjacent subfields. The issues concerning 30 Hz flicker and MPD artifacts when crossing thresholds, presented in the description of Mode 1, also apply in this mode. However, the redistribution of sustain pulses introduces a randomness factor. The result does not introduce a significant amount of new MPD during these transition periods. The following examples further illustrate the operation of Mode 2.

Figure 23:
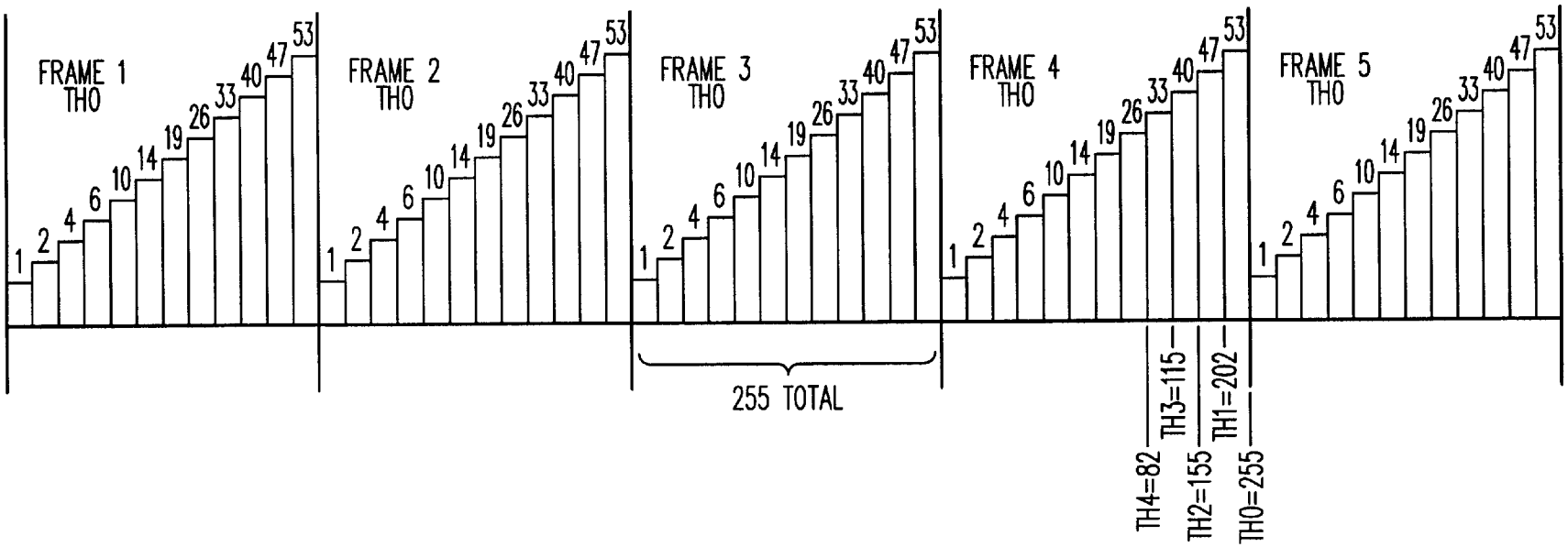
FIGS. 23–27 illustrate a technique for redistributing sustain pulses over 12 subfields according to the present invention.

Mode 2, Threshold 0. Refer to FIG. 23. The maximum pixel value is greater than TH1=202. All twelve subfields are used, and therefore none are available for redistribution of sustain pulses.

Figure 24:
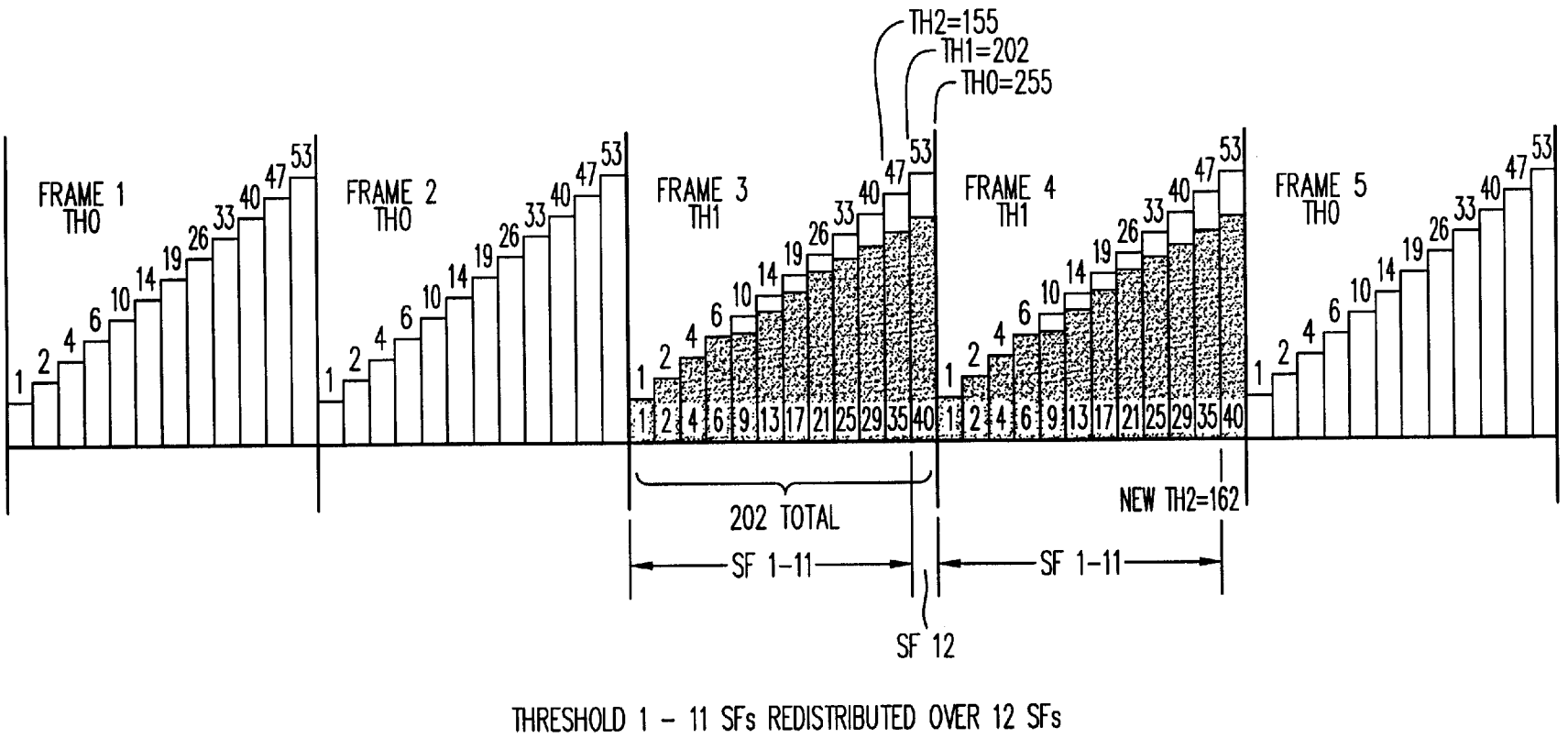

Mode 2, Threshold 1. Refer to FIG. 24. The maximum pixel value is less than or equal to TH1=202, and greater than TH2=155. Subfield 12 is not ordinarily used. The 202 sustain pulses originally in subfields 1 through 11 are redistributed over 12 subfields. FIG. 24, Frames 3 and 4, show a suggested redistribution.

Figure 25:
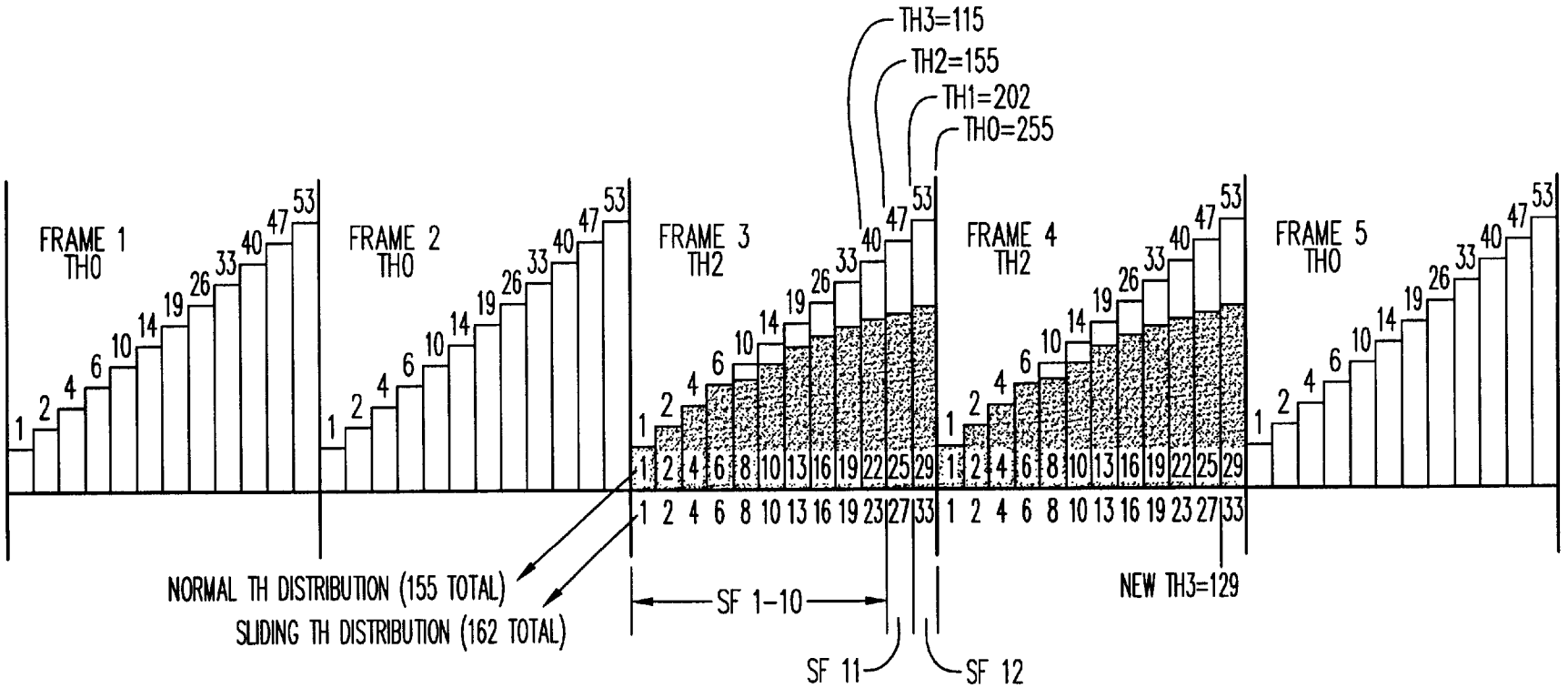

Mode 2, Threshold 2. Refer to FIG. 25. The maximum pixel value is less than or equal to TH2=155, and greater than TH3=115. Subfields 12 and 11 are not ordinarily used. The 155 sustain pulses originally in subfields 1 through 10 are redistributed over 12 subfields. FIG. 25, Frames 3 and 4, show a suggested redistribution.

Figure 26:
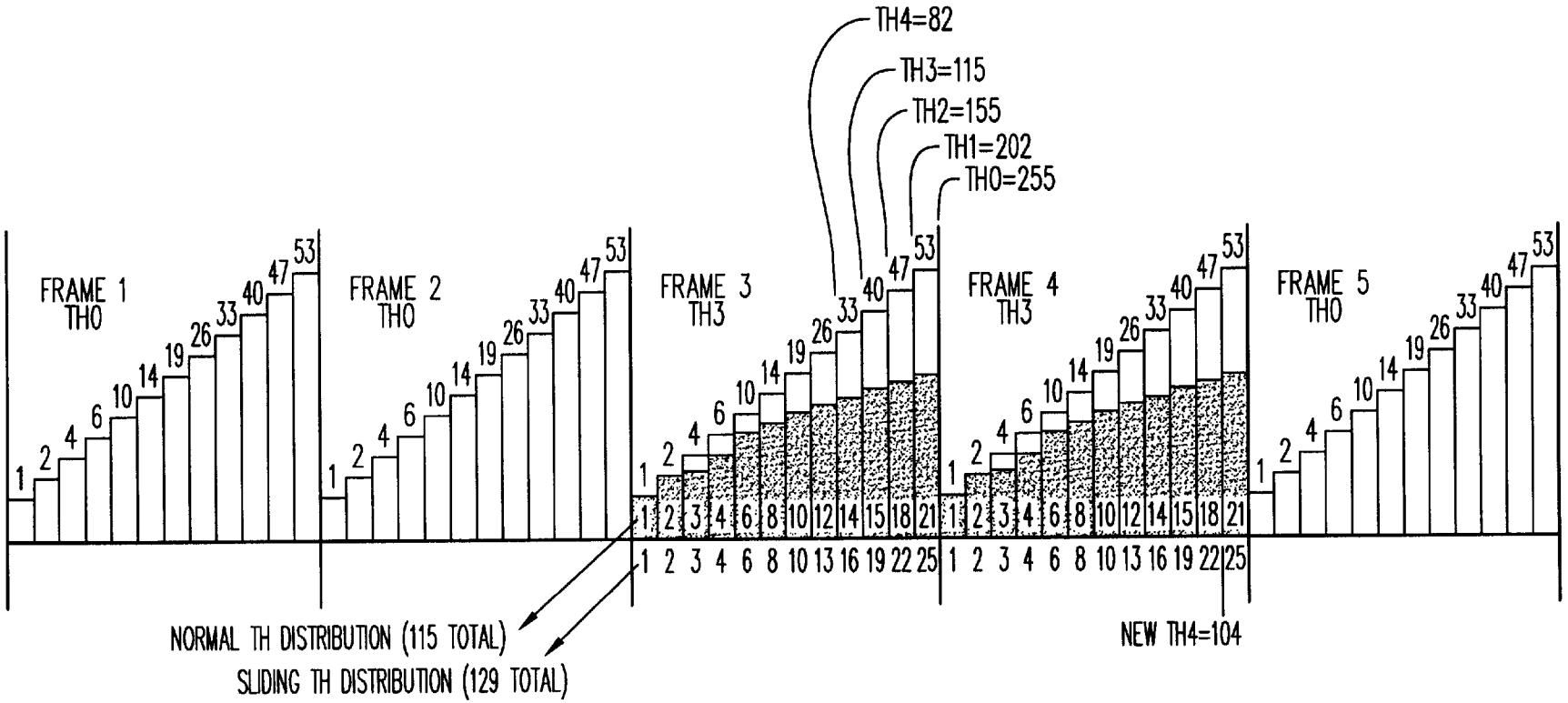

Mode 2, Threshold 3. Refer to FIG. 26. The maximum pixel value is less than or equal to TH3=115, and greater than TH4=82. Subfields 12, 11 and 10 are not ordinarily used. The 115 sustain pulses originally in subfields 1 through 9 are redistributed over 12 subfields. FIG. 26, Frames 3 and 4, show a suggested redistribution.

Figure 27:
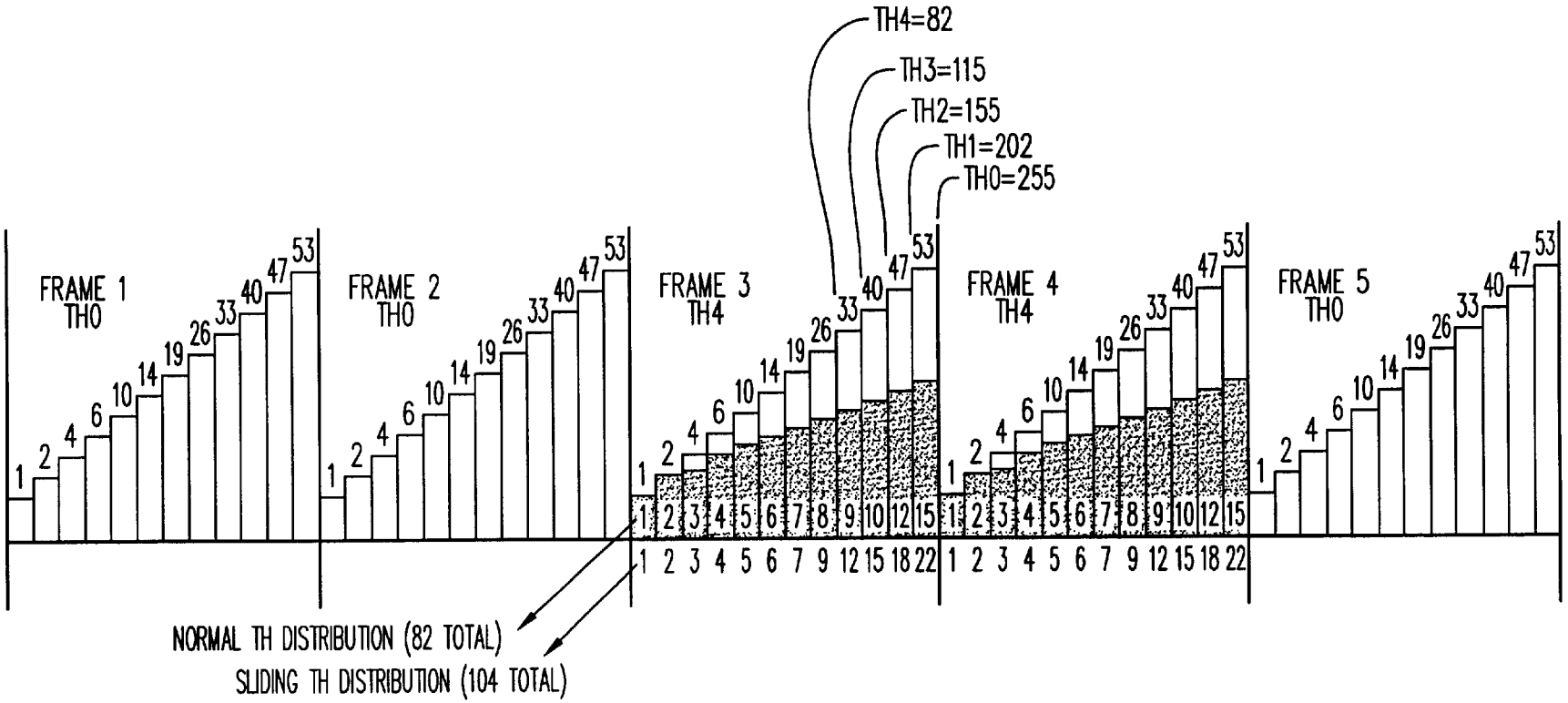

Mode 2, Threshold 4. Refer to FIG. 27. The maximum pixel value is less than or equal to TH4=82. Subfields 12, 11, 10 and 9 are not ordinarily used. The 82 sustain pulses originally in subfields 1 through 8 are redistributed over 12 subfields. FIG. 27, Frames 3 and 4, show a suggested redistribution.

The effectiveness of Mode 2 can be further enhanced by dynamically adjusting the thresholds based on the modified pulse distribution. That is, when the sustain pulses are redistributed over the 12 subfields, the boundaries of the subfields will change, and the thresholds of the subfields can be adjusted.

For example, refer again to FIG. 24, and assume that a detected peak pixel value is less than or equal to TH1=202, and greater than TH2=155. The 202 sustain pulses from subfields 1 through 11 are redistributed over 12 subfields. The modified distribution is shown in Frame 4, in which the new distribution of sustain pulses from subfields 1 through 11 totals 162. Accordingly, a New TH2=162 is defined for Frame 4.

Similarly, as shown in FIG. 25, with a sliding threshold distribution providing 162 sustain pulses over 12 subfields, a New TH3=129 is defined by totaling the sustain pulses from subfields 1 through 11.

Also, as shown in FIG. 26, with a sliding threshold distribution providing 129 sustain pulses over 12 subfields, a New TH4=104 is defined by totaling the sustain pulses from subfields 1 through 11.

The advantage of dynamically adjusting the thresholds is that the new thresholds will be crossed at higher luminance levels, thereby allowing more opportunity for redistribution of sustain pulses and, consequently, MPD reduction.

Another enhancement is realized by recognizing that the amount of dead time in a frame increases as a smaller total number of sustain pulses is redistributed over the 12 subfields. The dead time can be accumulated and allocated to create a new subfield.

Figure 28:
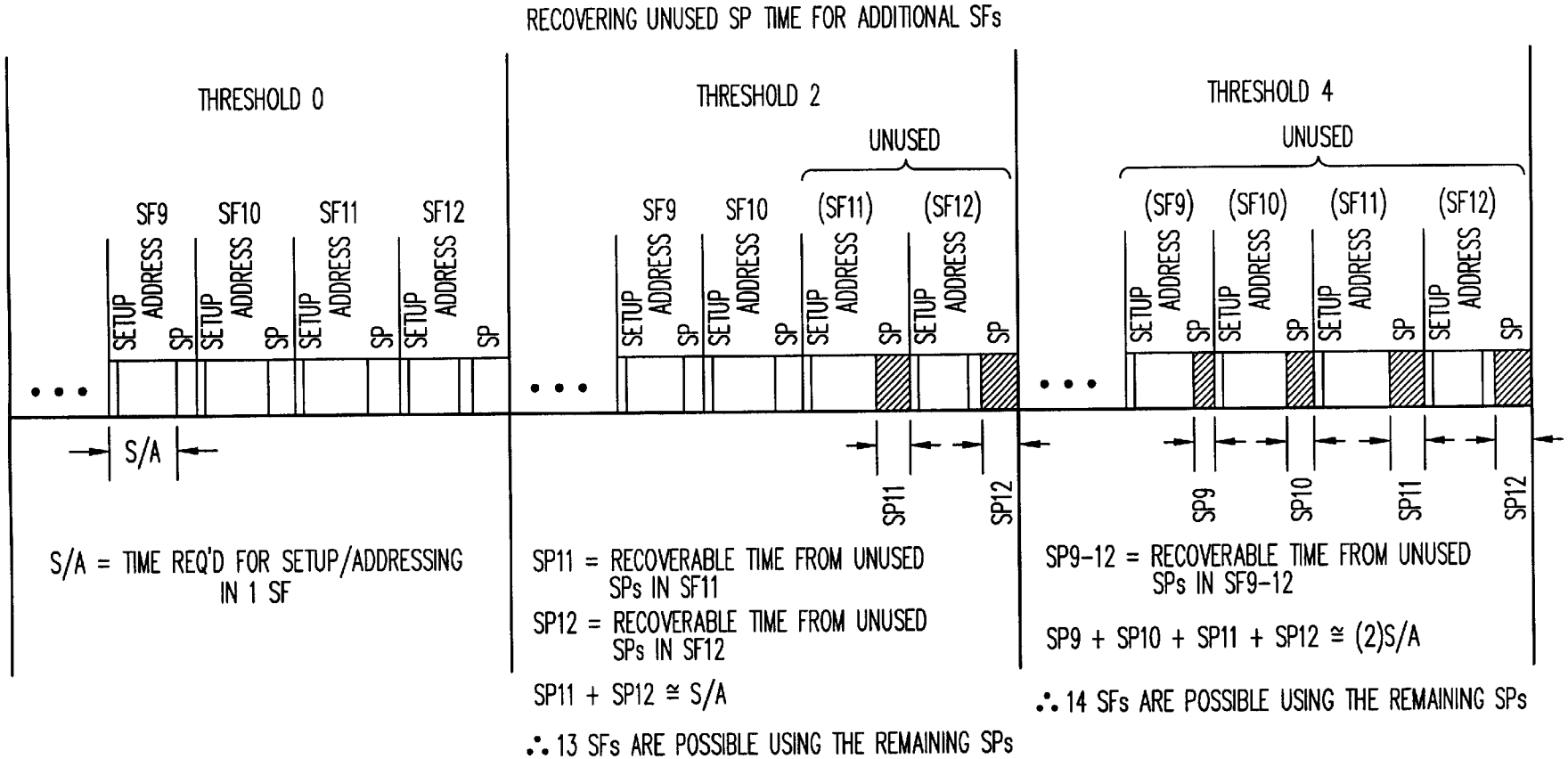
FIG. 28 illustrates a technique by which dead time is accumulated and allocated to create a new subfield in accordance with the present invention.

FIG. 28 illustrates the technique by which dead time is accumulated and allocated to create a new subfield. "S/A" represents a time interval required for setting up and addressing a subfield. Depending on the threshold, subfields 9, 10, 11 and 12 will each include an interval of dead time during which no sustain pulses are generated. The intervals, SP9, SP10, SP11 and SP2 represent the recoverable time from the original subfields 9 through 12, respectively.

When a maximum pixel value falls below threshold 2, subfields 11 and 12 are ordinarily not used. SP11 and SP12 can be recovered and allocated to create a new subfield, i.e., a thirteenth subfield.

Likewise, when the maximum pixel value falls below threshold 4, subfields 9, 10 11 and 12 are ordinarily not used. SP9, SP10, SP11 and SP12 can be recovered and allocated to create two new subfields, i.e., a thirteenth and fourteenth subfield.

Figure 29:
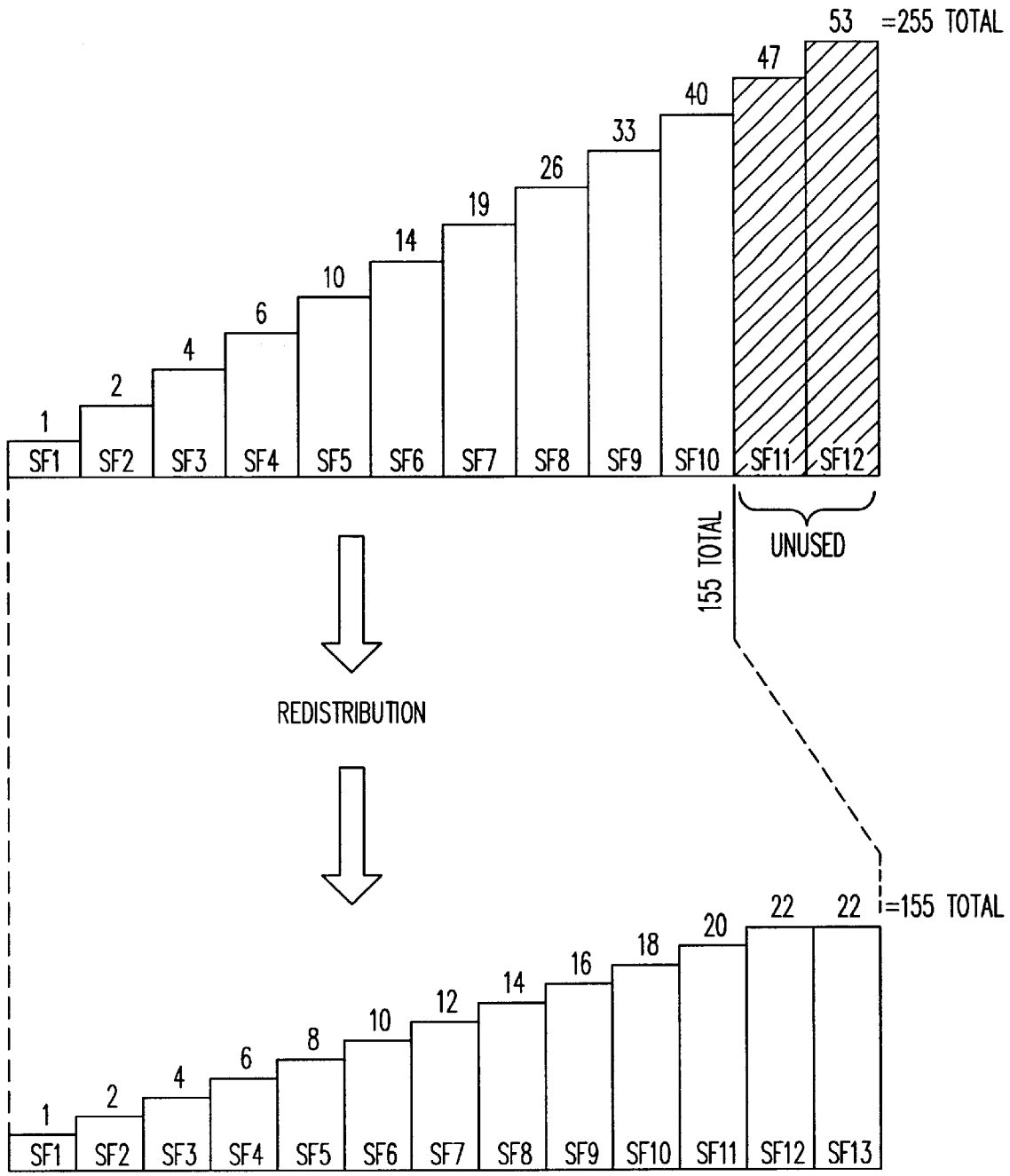
FIGS. 29 and 30 show suggested redistributions of sustain pulses to include thirteen and fourteen subfields in accordance with the present invention.
Figure 30:
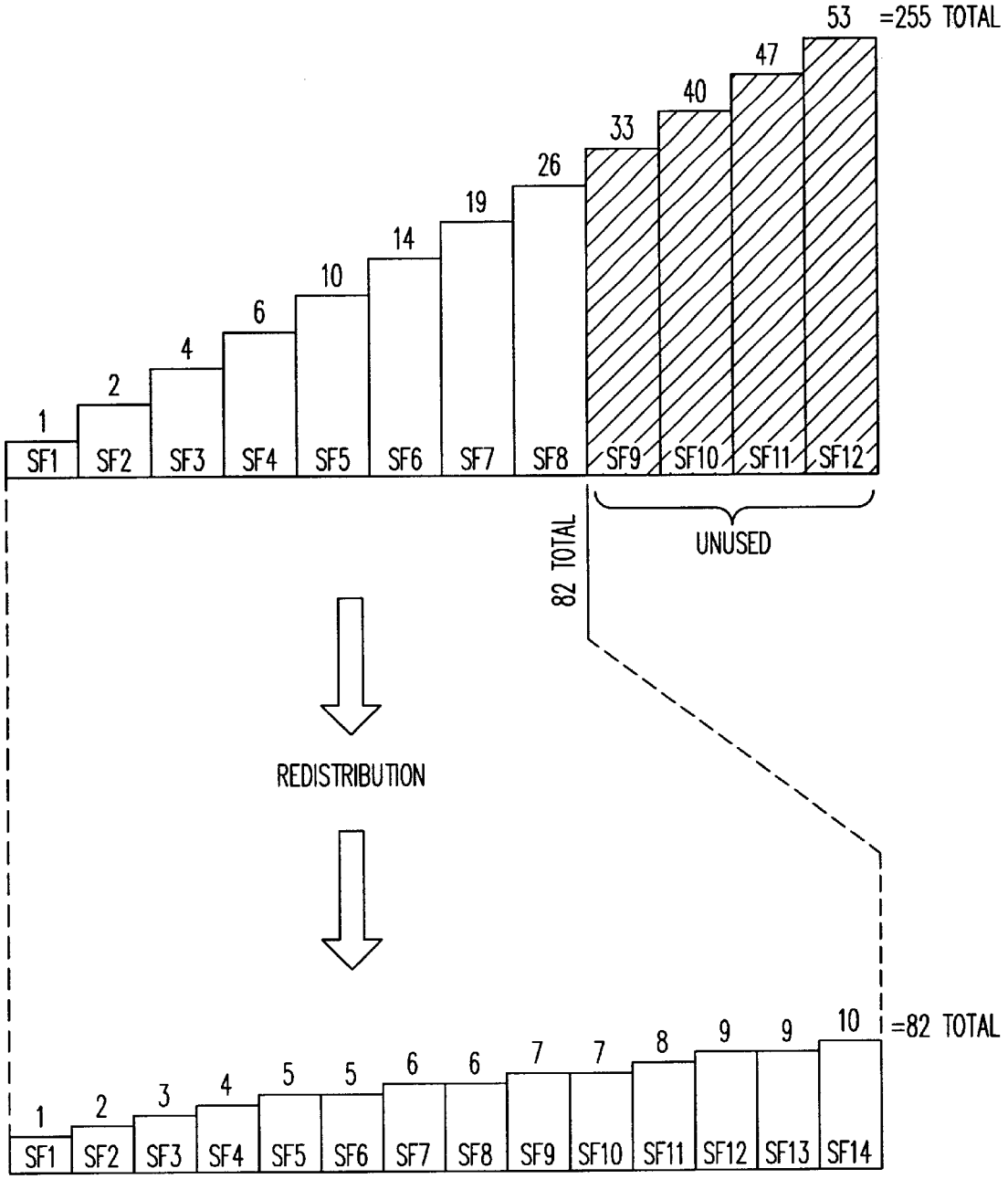

FIGS. 29 and 30 show suggested redistributions of sustain pulses to include thirteen and fourteen subfields, respectively. These distributions over thirteen and fourteen subfields further reduce the variation in the numbers of sustain pulses between subfields, which further reduces MPD.

Depending on the threshold level that is crossed by a maximum pixel value, a combination of enhanced low-level resolution (Mode 1) and MFD reduction (Mode 2) may be achieved. As more thresholds are crossed due to decreasing image pixel values, more choices are possible regarding the utilization of the upper subfields. In a case where the maximum pixel value is less than or equal to TH4, 4 pseudo grayscale bits can be added and 2 additional subfields can be created, for a total of 14 subfields, over which the sustain pulses can be redistributed. The following examples describe several scenarios, but others are possible.

Combined Modes, Threshold 1. The maximum pixel value is less than or equal to TH1=202 and greater than TH2=155. Subfield 12 is not ordinarily used. A choice may be made to utilize either Mode 1 or Mode 2.

Figure 31:
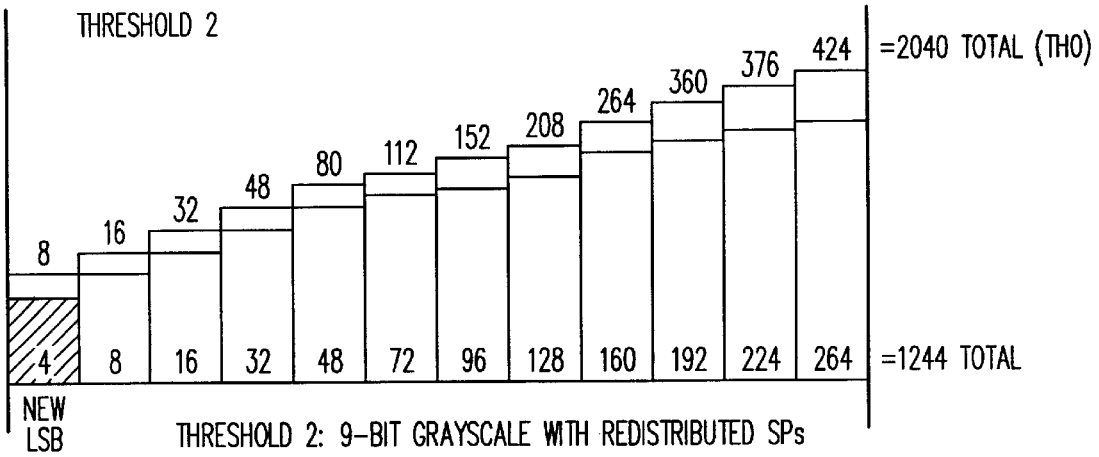
FIGS. 31–33 illustrate combinations of a technique for allocating pulses to subfields, and for redistributing sustain pulses over 12 subfields according to the present invention.

Combined Modes, Threshold 2. Refer to FIG. 31. The maximum pixel value is less than or equal to TH2=155, and greater than TH3=115. Subfields 12 and 11 are not ordinarily used, and are thus available for image enhancement. One of these available subfields is situated on the left end of the pulse distribution and used for new LSBs (Mode 1). The other available subfield is used to allow a redistribution of sustain pulses (Mode 2).

Figure 32:
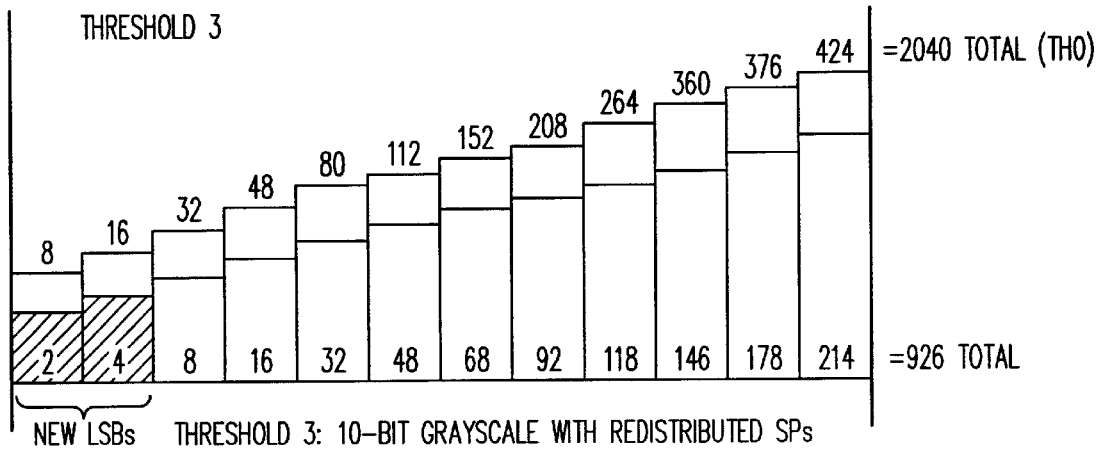

Combined Modes, Threshold 3. Refer to FIG. 32. The maximum pixel value is less than or equal to TH3=115, and greater than TH4=82. Subfields 12, 11 and 10 are not ordinarily used, and are thus available for image enhancement. Two of these available subfields are situated on the left end of the pulse distribution and used for new LSBs (Mode 1). The other available subfield is used to allow a redistribution of sustain pulses (Mode 2). Alternatively, only one of the available subfields can be used for a new LSB, and the other two available subfields can be used for redistribution of pulses.

Figure 33:
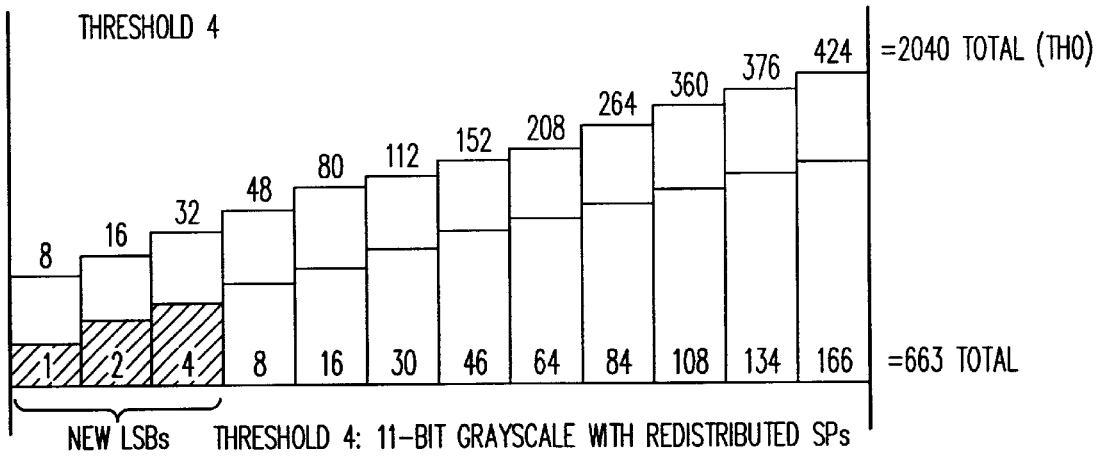

Combined Modes, Threshold 4. Refer to FIG. 33. The maximum pixel value is less than or equal to TH4=82. Subfields 12, 11, 10 and 9 are not ordinarily used, and are thus available for image enhancement. Three of these available subfields are situated on the left end of the pulse distribution and used for new LSBs (Mode 1). The other available subfield is used to allow a redistribution of sustain pulses (Mode 2). Alternatively, only one or two of the available subfields can be used for new LSBs, and the remaining available subfields can be used for redistribution of pulses.

In Mode 3, driving circuits for the display are turned OFF during unused subfields. This feature results in a reduction of quiescent-state power for the addressing and sustaining driver circuits.

Figure 34:
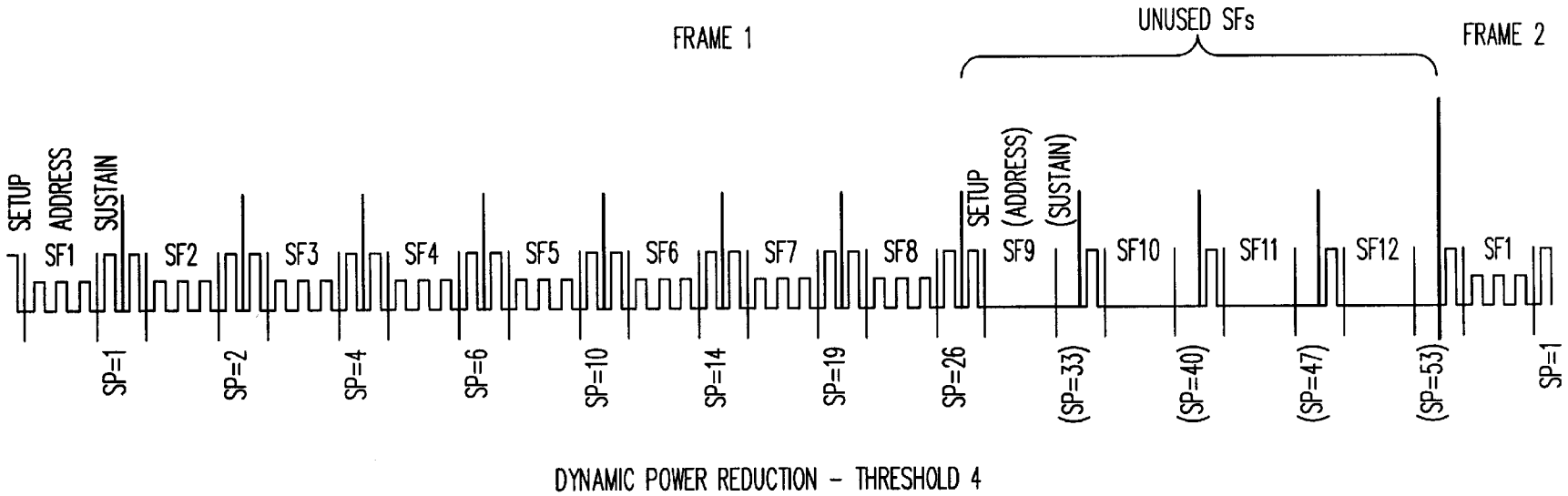
FIG. 34 illustrates an example of a technique of dynamic power reduction in accordance with the present invention.

FIG. 34 illustrates an example of dynamic power reduction for a case where the maximum pixel value is less than or equal to Threshold 4. Subfields 9, 10, 11 and 12 are not ordinarily used. Therefore, the driver circuits can be turned OFF during these subfields. In this case, quiescent-state power to the addressing circuits is reduced by 33%, and quiescent-state power to the sustain circuits is reduced by 68%.

Several other techniques can be applied to further enhance the effectiveness of the present invention. These techniques include a high luminance filter, hysteresis logic, and scene detect logic as described below.

The high luminance filter deals with a situation where the maximum pixel value is associated with only a small portion of the total image. For example, a bright star, 5 pixels in size, is present in a nighttime scene. The high intensity of the star is represented by a maximum pixel value that does not fall below an of the thresholds, and therefore no subfields are available for image enhancement. The high luminance filter overcomes this problem by discarding pixels associated with a high luminance region that represents less than a small percentage, for example 1%, of the total image. The greatest threshold level that is less than the filtered high intensity pixel value is then selected as the threshold for the frame of image data. For example, if the given 5 pixels in the bright star have a value of 210TH1=202 is selected for that frame because it is the greatest threshold level that is less than 210. The filtered data is then limited to 202. This technique assures that the filtered data is not grossly limited to a much lower threshold value, which would unnaturally limit the dynamic range of the intensity of the image.

The hysteresis logic deals with a situation where a maximum peak value, from frame-to-frame, toggles about a threshold. This toggling will cause a 30 Hz flicker of the image as new LSBs are alternately activated and deactivated. The hysteresis logic overcomes this problem by creating a hysteresis band having an upper and lower boundary. A maximum pixel value must cross one of the boundaries in order for a threshold to change.

Figure 35:
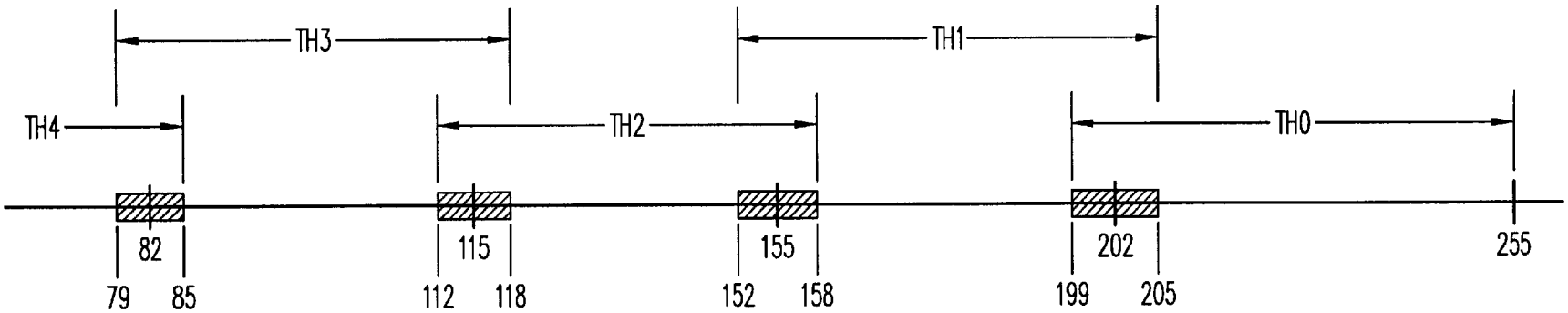
FIG. 35 is a graph showing several threshold levels, each with a hysteresis band in accordance with the present, invention.

For example, FIG. 35 is a graph showing the thresholds, each with a hysteresis band providing ±3 counts of hysteresis. A maximum pixel that is initially greater than TH1=202, and therefore in the range of TH0, must fall below 199 for the threshold to transition from TH0 to TH1. Conversely, if the pixel value is in the range of TH1, it must subsequently climb to greater than 205 for the threshold to transition from TH1 to TH0.

The scene detect logic deals with a situation where minor frame-to-frame variations in an image cause changes in the pulse distribution. These variations appear as a low rate, but undesirable, modification of the image intensity. The scene detect logic permits a change in threshold only when the image has changed from a previous image by a predetermined amount. That is, the scene detect logic will inhibit the alteration of the pulse distribution when the image has not changed by the predetermined amount. Image content for one frame is determined by summing the 8-bit data value for every full-color pixel (RGB) as it is written into a frame memory. The scene is regarded as having changed if the absolute difference of the total data content between two frames is greater than the predetermined amount. However, each threshold should be assigned an absolute maximum and minimum value so that the system will recognize a case where the maximum pixel value is well beyond the range of the current threshold, although a scene change is not detected. By recognizing the absolute values, thresholds will change appropriately for slow fade-ins and fade-outs, even though the image data from frame-to-frame may not differ enough to trigger a scene change.

Figure 36:
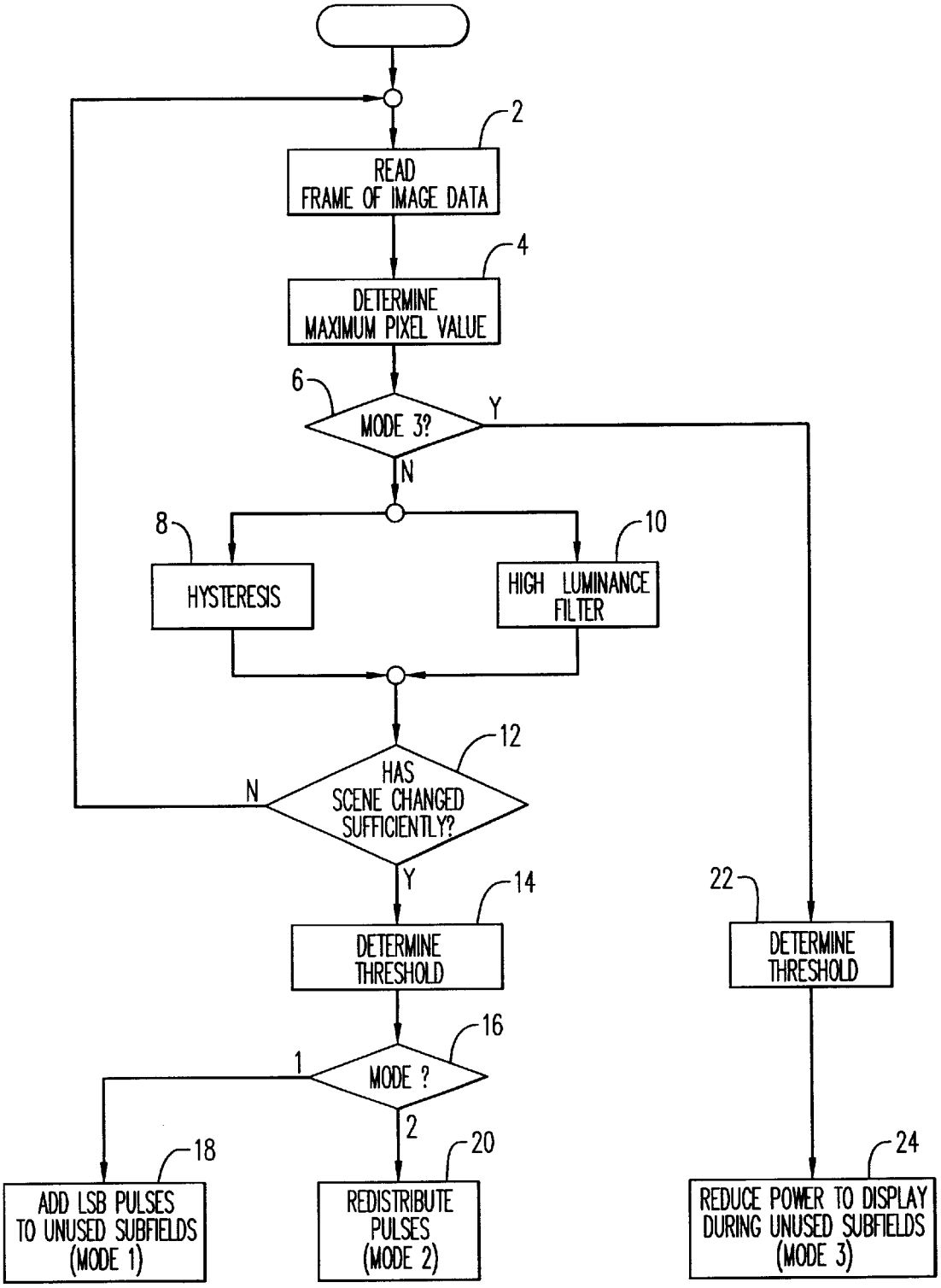
FIG. 36 is a flowchart of a method for improving image quality of a display in accordance with the present invention.

FIG. 36 is a flowchart of a method for improving image quality of a display in accordance with the present invention. The method is implemented in a system in which the display images pixels, each with an intensity represented by a respective pixel value. The display-is energized on a frame-time basis in which each frame includes a set of subfields. The intensity of a given pixel is controlled by applying sustain pulses to the subfields in accordance with a pulse distribution. Three modes of operation, as described above, are represented in this method. However, the method can be implemented to apply any of the three modes individually. The method begins with step 2.

In step 2, the method reads a frame of image data. The method then advances to step 4.

In step 4, the method evaluates the frame of image data and finds a maximum pixel value. The method then advances to step 6.

In step 6, the method evaluates the desired mode of operation for the system. If the desired mode is Mode 3, then the method branches to step 22. If the desired mode is not Mode 3, then the method advances to steps 8 and 10.

Step 8 is an embodiment of the hysteresis logic, and step 10 is an embodiment of the high luminance filter, both of which are described above. The sequence in which these steps are executed is not critical to the operation of the present invention, so they are represented here as being performed in parallel.

Referring to step 8, recall that a given subfield has an associated threshold value related to a number of pulses allocated to subfields prior in time in the frame. The method defines a hysteresis band around the subfield thresholds. The intent of the hysteresis band is to prevent a sequence of maximum pixel values that alternate above and below an original threshold value, from toggling about the original threshold value. The threshold values are adjusted so that a relationship between a current maximum pixel value and the threshold is retained until a subsequent maximum pixel value changes by more than a predetermined amount from the current maximum pixel value. The method then advances to step 12.

Referring to step 10, the method limits an intensity of a pixel associated with a high-luminance region of the image that represents less than a predetermined percentage of the image. This step may or may not limit the maximum pixel value, but for the sake of clarity, in subsequent steps, the result from step 10 is referred to as the resultant maximum pixel value. The method then advances to step 12.

In step 12, the method determines whether the image has changed a predetermined amount as compared to a previous image. This step is an embodiment of the scene detect logic described above. The point at which this step is performed is not critical to the operation of the present invention. For example, the scene detect operation of step 12 could be performed before the hysteresis operation of step 8 and the high luminance filter of step 10. If the image has not changed by the predetermined amount, then the method loops back to step 2. If the image has changed by the predetermined amount, then the method advances to step 14.

In step 14, the resultant maximum pixel value is compared to a threshold that correlates to a sustain pulse distribution boundary of a subfield. The threshold is related to a number of pulses allocated to subfields prior in time in a frame. In the preferred embodiment, the method identifies the subfield having the smallest associated threshold that is also greater than the maximum pixel value. When the maximum pixel value is less than a threshold, the method will alter the number of pulses allocated to subfields occurring after that threshold. The method then advances to step 16.

In step 16, the method evaluates the desired mode of operation for the system. If the desired mode is Mode 1, then the method advances to step 18. If the desired mode is Mode 2, then the method advances to step 20.

In step 18, in accordance with Mode 1, the method allocates new LSB sustain pulses to subfields that are otherwise unused. The method steps of Mode 1 are further described below in association with FIG. 37.

In step 20, in accordance with Mode 2, the method redistributes sustain pulses. The method steps of Mode 2 are further described below in association with FIG. 38.

In step 22, the resultant maximum pixel value is compared to a threshold that correlates to a sustain pulse distribution boundary of a subfield. The threshold is related to a number of pulses occurring prior in time in subfields in a frame. The method then advances to step 24.

In step 24, in accordance with Mode 3, the method reduces power consumed by the display. The method steps of Mode 3 are further described below in association with FIG. 39.

Figure 37:
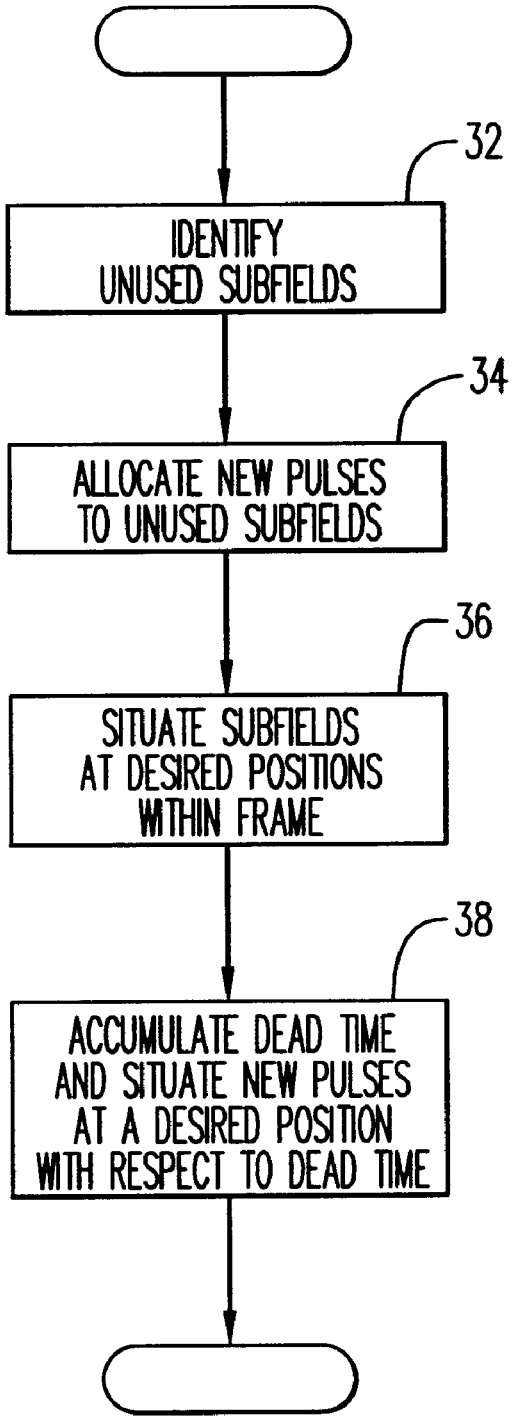
FIG. 37 is a flowchart of a method for improving low-level resolution of a display in accordance with the present invention.

FIG. 37 is a flowchart of a method for improving image quality of a display in accordance with Mode 1 of the present invention. Mode. 1 modifies the pulse distribution based on the maximum pixel value in order to improve low-level resolution of the display. This method begins with step 32.

In step 32, the method identifies a subfield, based on a relationship between a threshold value and the maximum pixel value, for alteration of a number of pulses present in the subfield. Note that the maximum pixel value was determined in step 4 of FIG. 36, but it may have been limited by the high luminance filter in step 10 of FIG. 36 to yield a resultant maximum pixel value. Note also that step 8 of FIG. 36 defined a hysteresis band about the threshold levels. In the preferred embodiment, the method compares the resultant maximum pixel value to the thresholds associated with the subfields and identifies one or more subfields having an associated threshold value that is greater than the resultant maximum pixel value. The method identifies a subfield having a smallest associated threshold value that is also greater than the resultant maximum pixel value. When the resultant maximum pixel value is less than a threshold, subfields occurring after that threshold can be used for the production of new pulses. The method then advances to step 34.

In step 34, the method allocates one or more new pulses to the unused subfields. The method then advances to step 36.

In step 36, the method situates subfields at desired positions within the frame. The one or more subfields identified in step 32 can be situated at any position in the frame, but in a preferred arrangement, the subfields will be located at the end of the frame, just prior to a beginning of a subsequent frame. The method then advances to step 38.

In step 38, the method accumulates dead time from the subfields with the new pulses, and situates the new pulses at an optimum position within the frame with respect to the dead time. In the preferred arrangement, new pulses are situated after the accumulated dead time.

Figure 38:
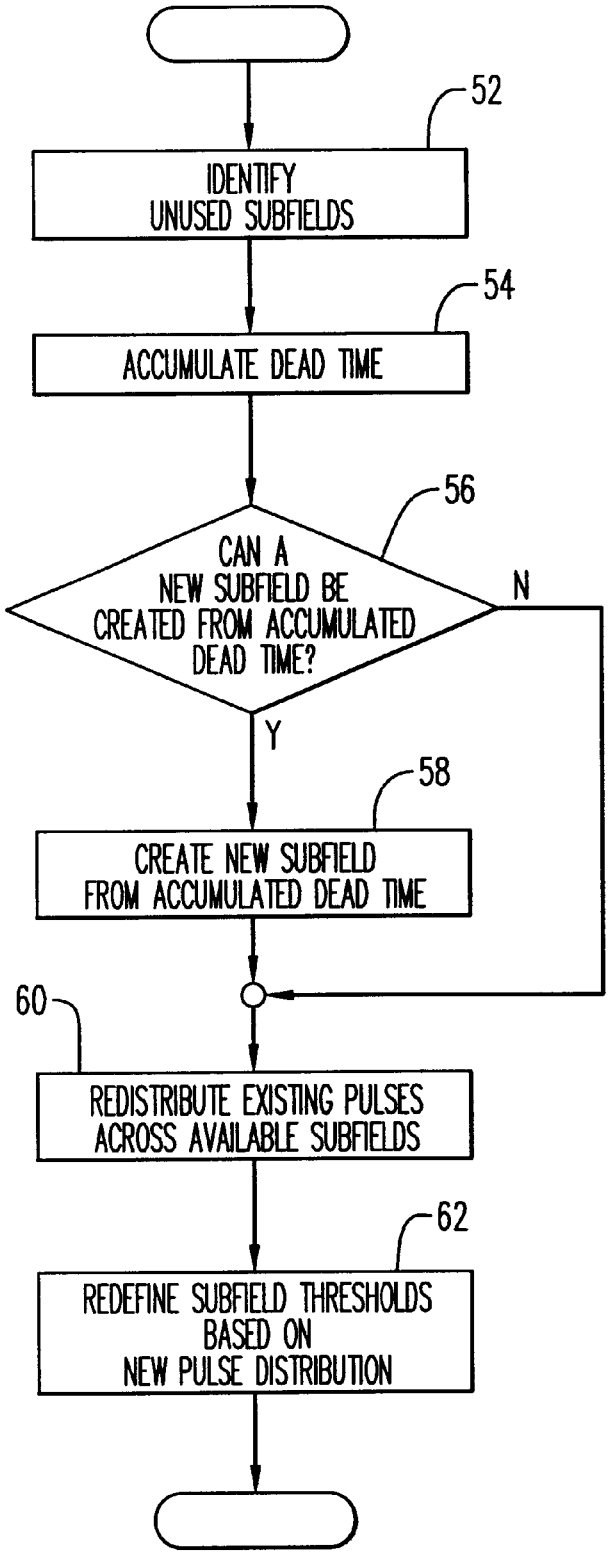
FIG. 38 is a flowchart of a method for reducing moving picture disturbance in accordance with the present invention.

FIG. 38 is a flowchart of a method for improving image quality of a display in accordance with Mode 2 of the present invention. Mode 2 modifies the pulse distribution based on the maximum pixel value in order to reduce MPD. This method begins with step 52.

In step 52, the method identifies a subfield, based on a relationship between a threshold value and the maximum pixel value, for alteration of a number of pulses present in the subfield. Note that the maximum pixel value was determined in step 4 of FIG. 36, but it may have been limited by the high luminance filter in step 10 of FIG. 36 to yield a resultant maximum pixel value. Note also that step 8 of FIG. 36 defined a hysteresis band about the threshold levels. In the preferred embodiment, the method compares the resultant maximum pixel value to the thresholds associated with the subfields and identifies one or more subfields having an associated threshold value that is greater than the resultant maximum pixel value. The method identifies a subfield having a smallest associated threshold value that is also greater than the resultant maximum pixel value. When the resultant maximum pixel value is less than a threshold, subfields occurring after that threshold can be used for a redistribution of existing pulses. The method then advances to step 54.

In step 54, the method accumulates dead time from subfields within the frame. Dead time is a time during which no pulse is generated. The method then advances to step 56.

In step 56, the method determines whether a new subfield can be created in place of the accumulated dead time. If a new subfield can be created, then the method advances to step 58. If a new subfield cannot be created, then the method branches to step 60.

In step 58, the method creates one or more new subfields from the accumulated dead time. The method then advances to step 60.

In step 60, the method redistributes pulses across all available subfields. In particular, the pulses required to produce the desired level of luminance are redistributed over all of the subfields, including subfields identified in step 52, and new subfields created in step 58. The method then advances to step 62.

In step 62, the thresholds are adjusted based on the modified pulse distribution. This step is an embodiment of the technique of dynamically adjusting the thresholds, as described above.

Figure 39:
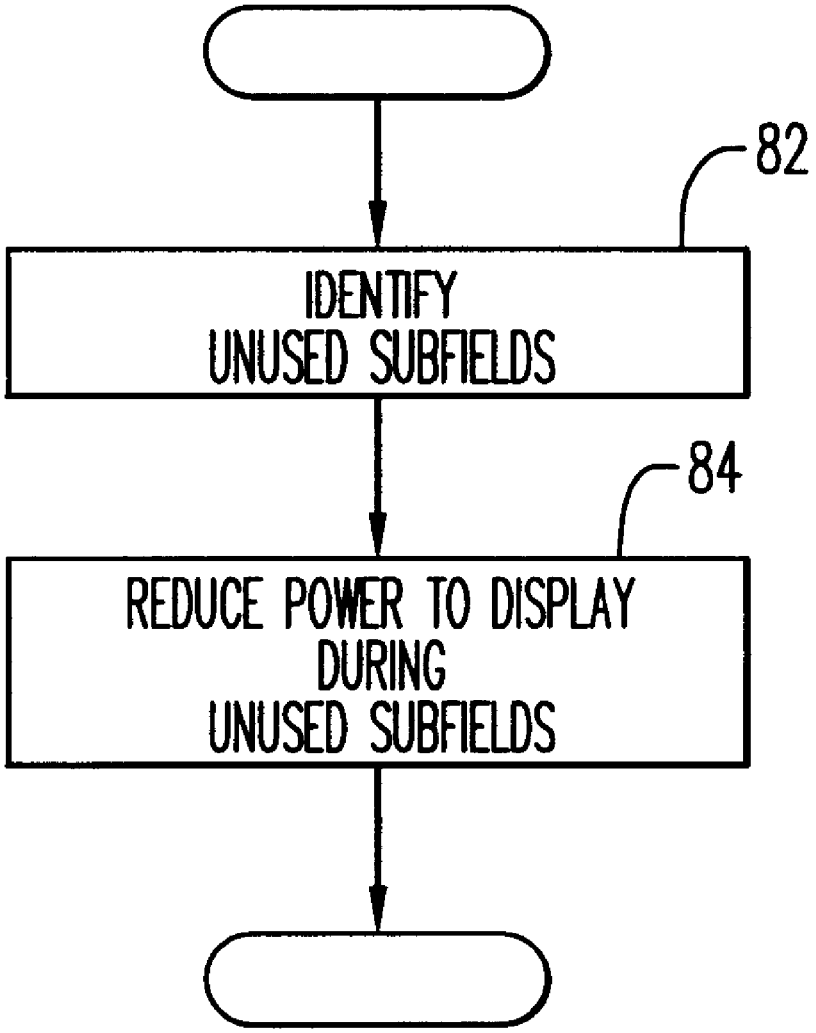
FIG. 39 is a flowchart of a method for reducing power consumed by a display in accordance with the present invention.

FIG. 39 is a flowchart of a method for reducing power consumed by a display in accordance with Mode 3 of the present invention. This method begins with step 82.

In step 82, the method identifies an unused subfield, based on a relationship between a threshold value and the maximum pixel value. Note that the maximum pixel value was determined in step 4 of FIG. 36, but it may have been limited by the high luminance filter in step 10 of FIG. 36 to yield a resultant maximum pixel value. Note also that step 8 of FIG. 36 defined a hysteresis band about the threshold levels. In the preferred embodiment, the method compares the resultant maximum pixel value to the thresholds associated with the subfields and identifies one or more subfields having an associated threshold value that is greater than the resultant maximum pixel value. The method identifies a subfield having a smallest associated threshold value that is also greater than the resultant maximum pixel value. When the resultant maximum pixel value is less than a threshold, subfields occurring after that threshold indicate a period of time during which power to the display can be reduced.

In step 84, the method reduces power to the display during the time of the one or more subfields identified in step 82.

Figure 40:
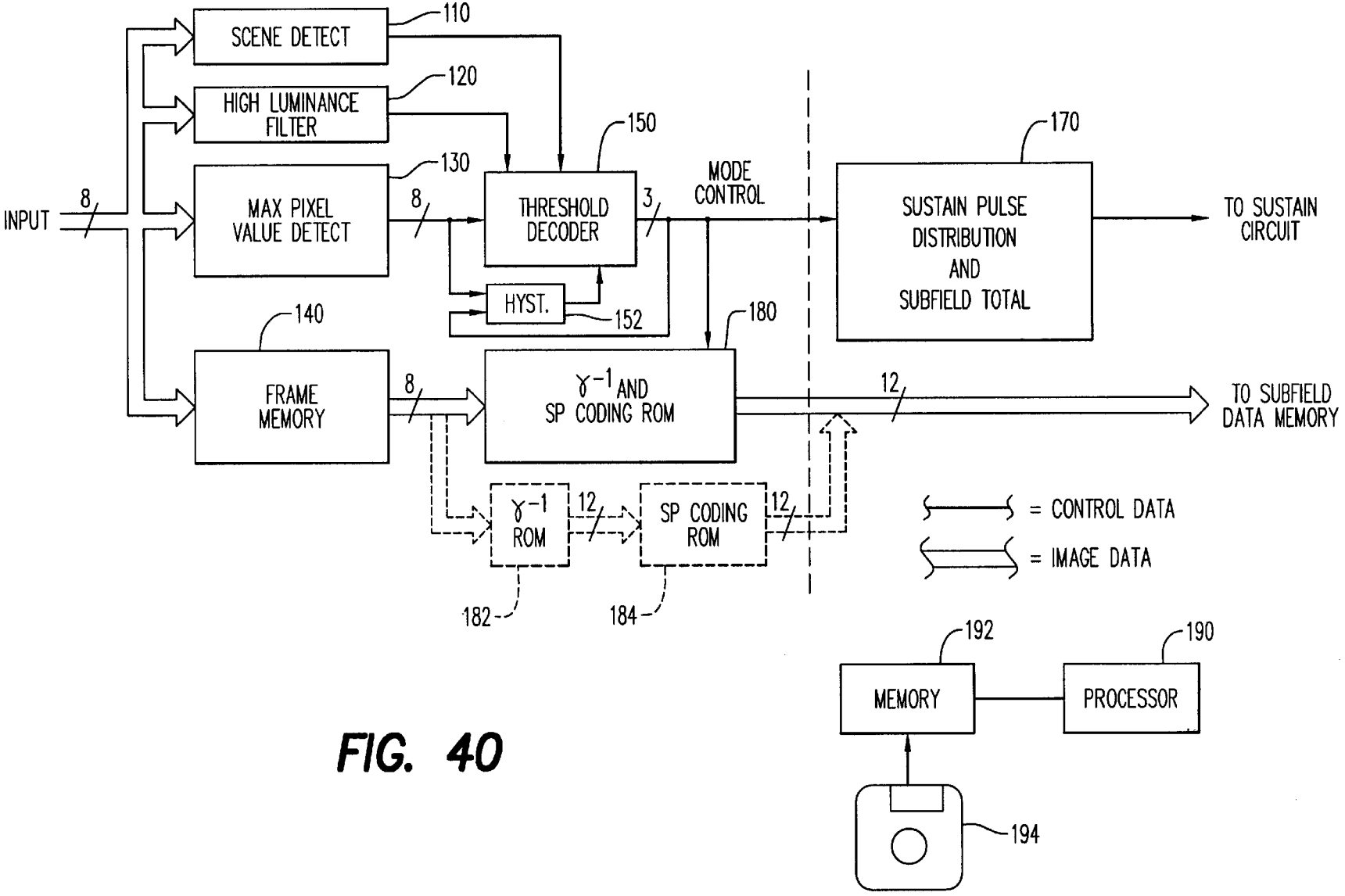
FIG. 40 is a block diagram of a circuit for receiving an 8-bit gamma corrected video signal and improving the image quality of a display in accordance with the present invention.

FIG. 40 is a block diagram of a circuit for receiving an 8-bit gamma corrected video signal and improving the image quality of a display in accordance with the present invention. For simplicity, the block diagram describes the data path for one color (i.e., red, green or blue). The primary components of the circuit include a maximum pixel value detector 130, a frame memory 140, an inverse-gamma correction and sustain pulse coding read only memory (ROM) 180, and a sustain pulse distribution and subfield total circuit 170. Additionally, the circuit includes a scene detect circuit 110, a high luminance filter 120, a threshold decoder 150, and a hysteresis circuit 152.

The circuit can be implemented with discrete components or in firmware. Alternatively, it can be implemented in a processor 190, with associated memory 192. While the procedures required to execute the invention hereof are indicated as already loaded into memory 192, they may be configured on a storage media, such as data memory 194 for subsequent loading into memory 192.

All of the 8-bit gamma corrected image data for one frame is written to frame memory 140. Frame memory 140 is a temporary holding area for the image data.

Maximum pixel value detector 130 evaluates the image data while it is being written to frame memory 140. Maximum pixel value detector 130 outputs a maximum pixel value for the frame of image data.

Scene detect circuit 110 determines whether an image has changed from a previous image by a predetermined amount. The scene is regarded as having changed if the absolute difference of the total data content between two frames is greater than a predetermined amount. It produces an output indicating whether the scene has changed. This circuit is an embodiment of the scene detect logic described above.

High luminance filter 120 limits the intensity of pixels associated with a high luminance region that represents less than a small percentage of the total image. This overrides the maximum pixel value detector 130 when the filter conditions are met.

Hysteresis circuit 152 considers the threshold of the previous frame, and the hysteresis bandwidth to determine whether a difference between a first maximum pixel value and a subsequent maximum pixel value is sufficient to warrant a transition between thresholds.

Threshold decoder 150 receives the outputs from scene detect circuit 110, high luminance filter 120, maximum pixel value detector 130, and hysteresis circuit 152. After accounting for the scene change, high luminance, and hysteresis, threshold decoder 150 compares the resultant maximum pixel value with the thresholds corresponding to the subfield boundaries. By identifying which thresholds have been crossed, the system can identify subfields that are not ordinarily used to produce sustain pulses for the desired level of luminance. For example, referring to FIG. 10, a maximum pixel value of less than or equal to TH2=155, and greater than TH3=115 indicates that subfields 11 and 12 are available for image enhancement.

Threshold decoder 150 produces a mode control indicating which threshold has been crossed. Table 2 lists the thresholds and corresponding mode control values.

TABLE 2

| | Mode Control Bits | | |
|---|---|---|---|
| | Mode Control Bits | | |
| Threshold Decode | 2 | 1 | 0 |
| Threshold 0 | 0 | 0 | 0 |
| Threshold 1 | 0 | 0 | 1 |
| Threshold 2 | 0 | 1 | 0 |
| Threshold 3 | 0 | 1 | 1 |
| Threshold 4 | 1 | 0 | 0 |

The inverse-gamma correction and sustain pulse coding ROM 180 obtains data from frame memory 140 and obtains the mode control from threshold decoder 150. The inverse-gamma correction and sustain pulse coding ROM 180 applies inverse gamma correction to the 8-bit image data and produces 12-bit image data that is sent to a subfield data memory.

In Mode 1, which operates to enhance low level resolution, the inverse-gamma correction and sustain pulse coding ROM 180 assign new LSBs to subfields 12, 11, 10, and 9 for TH1, TH2, TH3, and TH4, respectively, as shown in FIGS. 13–17. In Mode 2, for MPD reduction, ROM 180 redistributes the 8-bit input data to 12 subfields after inverse-gamma correction.

Note that threshold decoder 150 determines the mode before inverse-gamma correction and sustain pulse coding ROM 180 acts on the data from frame memory 140. This is because inverse-gamma correction and sustain pulse coding ROM 180 require the mode control in order to choose an appropriate 8–12 bit grayscaling. Since the threshold detection operation precedes inverse-gamma correction, the correct input values are selected for detection to correlate to the thresholds after inverse-gamma correction. For example, if Threshold 1 is crossed for image data=202, then input value 230 is detected based on the inverse-gamma calculation.

It is possible to apply inverse-gamma correction at the front end of the system. However, this would require a 12-bit data path for all detection processes as well as for the frame memory. This would result in unnecessarily complex and more expensive hardware. It is also possible to separate the inverse-gamma correction and sustain pulse coding ROM into an inverse-gamma correction ROM 182 and a sustain pulse coding ROM 184, as shown by dotted blocks in FIG. 40. However, this would require a 12-bit output from inverse-gamma correction ROM 182 into sustain pulse coding ROM 184. It simplifies the process and requires less hardware to implement both functions in one ROM.

The sustain pulse distribution and subfield total circuit 170 receives the mode control from threshold decoder 150. The sustain pulse distribution and subfield total circuit 170 generates sustain pulses for each subfield, to match that of the coded 12-bit data produced by the inverse-gamma correction and sustain pulse coding ROM 180, and sends the sustain pulses to a sustain circuit. The potential for enhanced grayscaling (9–12 bits) is determined in advance and is largely dependent on how many sustain pulses a given system can generate.

Sustain pulse distribution and subfield total circuit 170 and inverse-gamma correction and sustain pulse coding ROM 180 work in unison to modify the sustain pulse distribution. This includes the allocation of new pulses to subfields for improved low level resolution, and the redistribution of pulses to reduce MPD. They situate the subfields within the frame, and if possible, they produce new subfields from accumulated dead time.

When applying Mode 3 to reduce power, threshold decoder 150 utilizes only the input from maximum pixel value detector 130. Driving circuits for the display are turned OFF during unused subfields. Since Mode 3 does not alter the remaining subfields, the scene detect circuit 110, high luminance filter 120, and hysteresis circuit 152 are not required for operation of Mode 3.

The present invention can also be applied in a system that uses a 10-bit RGB input. 10-bit input sources are available in professional digital video formats. Also, other analog sources can be converted to 10 bits using a 10-bit analog-to-digital converter.

Having a 10-bit source will add more detail to the image at brighter levels, but the increased input resolution is not generally apparent at low levels where the slope of the inverse-gamma curve is very small. Instead, the 10-bit grayscaling inverse-gamma response is virtually identical for 8 and 10-bit inputs up to level 45 (8-bits) or 180 (10-bits). However, above this level, much more image detail will be provided from the 10-bit source as the slope of the inverse-gamma curve becomes steeper.

Figure 41:
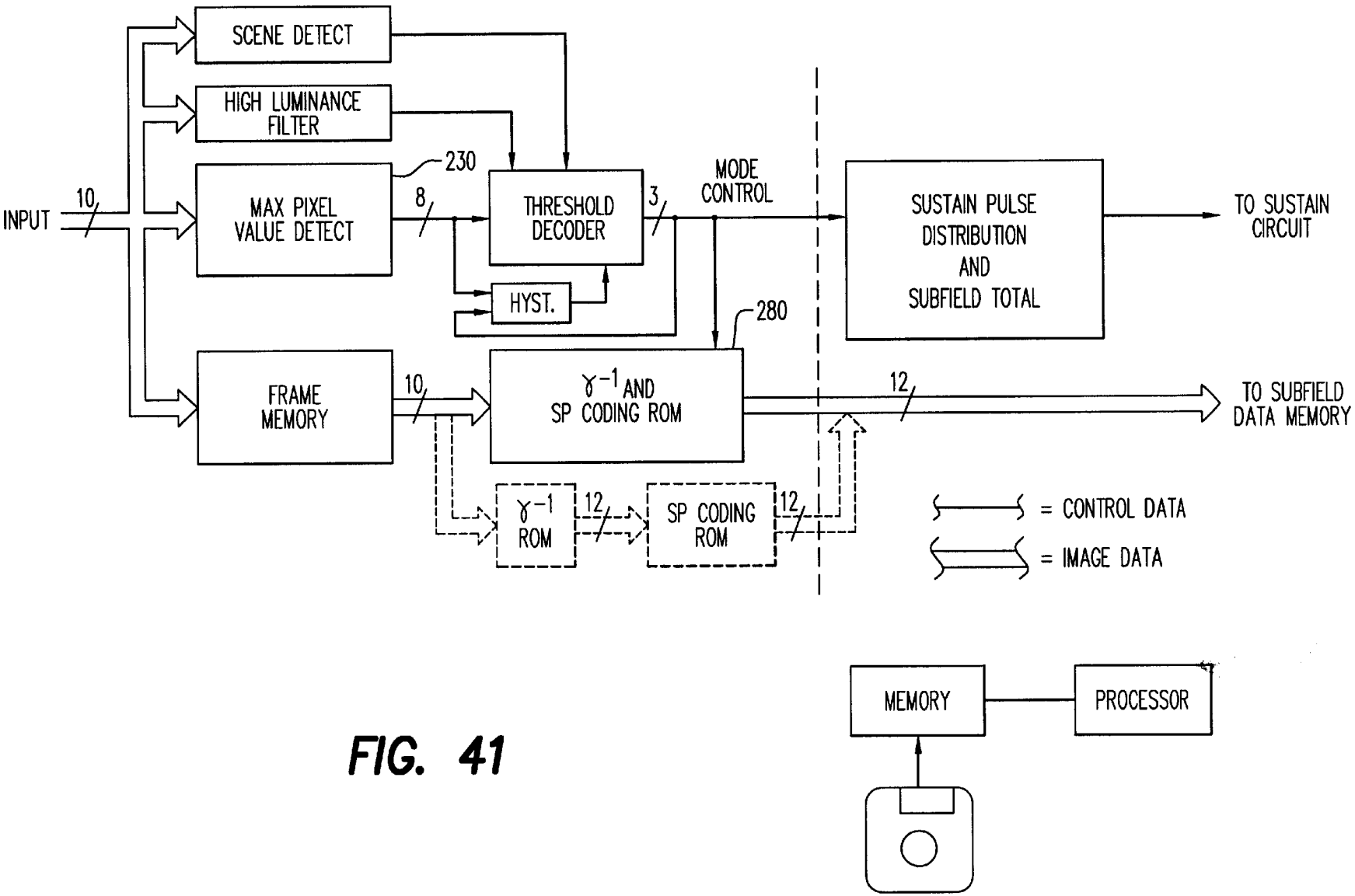
FIG. 41 is a block diagram of a circuit for receiving a 10-bit gamma corrected video signal and improving the image quality of a display in accordance with the present invention.

FIG. 41 is a block diagram of a circuit for receiving a 10-bit gamma corrected video signal. All modes described earlier for the 8-bit circuit in FIG. 40 can be applied using a 10-bit input. The major difference in the hardware is that the inverse-gamma correction and sustain pulse coding read only memory (ROM) 280 for the 10-bit system must be 4 times deeper to accommodate the 2 additional address (input data) bits. For simplicity, the maximum pixel value detector 230 truncates 2 LSBs before determining the maximum pixel value from 8 bits as described above.

When adding 1 or 2 new LSBs of grayscaling over the 12 subfields, these new inverse-gamma corrected bits will be derived from the 2 additional LSBs provided by the source. Any additional LSBs will be generated from the 12-bit output from inverse-gamma calculations as in the 8-bit system. The two additional source LSBs provide the extra image detail described above.

It should be understood that the foregoing description is only illustrative of the invention. Various alternatives and modifications can be devised by those skilled in the art without departing from the invention. Accordingly, the present invention is intended to embrace all such alternatives, modifications and variances that fall within the scope of the appended claims.

What is claimed is:

1. A method for improving an image on a display that images pixels, each of said pixels having an intensity represented by a respective pixel value, an intensity of a given pixel being associated with a number of pulses produced within subfields in a frame-time, wherein one of said subfields represents a least significant (LS) digit of said pixel value and has an LS number of pulses associated therewith, said method comprising the steps of:

determining a maximum pixel value to be imaged during said frame-time;

activating a number of pulses in a set of said subfields to represent said maximum pixel value to a resolution of said LS digit; and activating a number of additional pulses in a subfield that is not a member of said set, wherein said number of additional pulses is less than said LS number, and thus said resolution is enhanced beyond said LS digit.

2. The method of claim 1, wherein said subfield that is not a member of said set has an associated threshold value related to a number of pulses allocated to subfields prior in time in said frame-time, and wherein said method further comprises, before said step of activating said number of additional pulses, determining said subfield that is not a member of said set based on a relationship between said threshold value and said maximum pixel value.

3. The method of claim 1, wherein said pixel value is an N-bit value, and said display is capable of producing $P(2^N-1)$ pulses in a quantity of Q subfields in said frame-time, and wherein P is an integer greater than 0, and $Q \geqq N$.

4. The method of claim 1, further comprising situating said subfield that is not a member of said set at a predetermined position in said frame-time.

5. The method of claim 1, wherein said number of additional pulses is one.

6. The method of claim 1, wherein said number of additional pulses is equal to one half of said LS number.

7. The method of claim 1, wherein an individual pulse in said subfield that is not a member of said set yields less luminance than that of an individual pulse in a subfield in said set.

8. The method of claim 1, further comprising:

accumulating dead time, wherein said dead time is a time interval during which no pulse is generated;

allocating said dead time to a new subfield; and situating said new subfield at a predetermined position in said frame-time.

9. The method of claim 1, further comprising, before said step of activating said number of additional pulses, the step of limiting an intensity of a pixel associated with a high-luminance region of said image that represents less than a predetermined percentage of said image.

10. The method of claim 1, further comprising, before said step of activating said number of additional pulses, the step of inhibiting said step of activating said number of additional pulses when a value of data representing said image has not changed by a predetermined amount as compared to a value of data representing a previous image.

11. The method of claim 2, further comprising, after said step of activating said number of additional pulses, the step of adjusting said threshold value based on a distribution of pulses in said frame-time that includes said number of additional pulses.

12. The method of claim 2, wherein said maximum pixel value is a current maximum pixel value, and wherein said method further comprises adjusting said threshold value so that said relationship is retained until a subsequent maximum pixel value changes by more than a predetermined amount from said current maximum pixel value.

13. The method of claim 1, wherein dead time is a time interval during which no pulse is generated, and wherein said step of activating said number of additional pulses situates said additional pulses at a predetermined position in said frame-time with respect to said dead time.

14. A storage media that includes instructions for controlling a processor that, in turn, improves an image on a display that images pixels, each of said pixels having an intensity represented by a respective pixel value, an intensity of a given pixel being associated with a number of pulses produced within subfields in a frame-time, wherein one of said subfields represents a least significant (LS) digit of said pixel value and has an LS number of pulses associated therewith, said storage media comprising:

means for controlling said processor to determine a maximum pixel value to be imaged during said frame-time;

means for controlling said processor to activate a number of pulses in a set of said subfields to represent said maximum pixel value to a resolution of said LS digit; and means for controlling said processor to activate a number of additional pulses in a subfield that is not a member of said set, wherein said number of additional pulses is less than said LS number, and thus said resolution is enhanced beyond said LS digit.

15. The storage media of claim 14, wherein said subfield that is not a member of said set has an associated threshold value related to a number of pulses allocated to subfields prior in time in said frame-time, and wherein said storage media further comprises means for controlling said processor to determine said subfield that is not a member of said set, based on a relationship between said threshold value and said maximum pixel value.

16. The storage media of claim 14, wherein said pixel value is an N-bit value, and said display is capable of producing $P(2^N-1)$ pulses in a quantity of Q subfields in said frame-time, and wherein P is an integer greater than 0, and $Q \geqq N$.

17. The storage media of claim 14, further comprising, means for controlling said processor to situate said subfield that is not a member of said set at a predetermined position in said frame-time.

18. The storage media of claim 14, wherein said number of additional pulses is one.

19. The storage media of claim 14, wherein said number of additional pulses is equal to one half of said least significant number.

20. The storage media of claim 14, wherein an individual pulse in said subfield that is not a member of said set yields less luminance than that of an individual pulse in a subfield in said set.

21. The storage media of claim 14, further comprising:

means for controlling said processor to accumulate dead time, wherein said dead time is a time interval during which no pulse is generated;

means for controlling said processor to allocate said dead time to a new subfield; and means for controlling said processor to situate said new subfield at a predetermined position in said frame-time.

22. The storage media of claim 14, further comprising means for controlling said processor to limit an intensity of a pixel associated with a high-luminance region of said image that represents less than a predetermined percentage of said image.

23. The storage media of claim 14,further comprising means for controlling said processor to inhibit said activation of said number of additional pulses in a case where a value of data representing said image has not changed by a predetermined amount as compared to a value of data representing a previous image.

24. The storage media of claim 15, further comprising, means for controlling said processor to adjust said threshold value based on a distribution of pulses in said frame-time that includes said number of additional pulses.

25. The storage media of claim 15, wherein said maximum pixel value is a current maximum pixel value, and wherein said storage media further comprises means for controlling said processor to adjust said threshold value so that said relationship is retained until a subsequent maximum pixel value changes by more than a predetermined amount from said current maximum pixel value.

26. The storage media of claim 14, wherein dead time is a time interval during which no pulse is generated, and wherein said storage media further comprises means for controlling said processor to situate said additional pulses at a predetermined position in said frame-time with respect to said dead time.

27. A system for improving image quality of a display that images pixels, each of said pixels having an intensity represented by a respective pixel value, an intensity of a given pixel being associated with a number of pulses produced within subfields in a frame-time, wherein one of said subfields represents a least significant (LS) digit of said pixel value and has an LS number of pulses associated therewith, said system comprising:

means for determining a maximum pixel value to be imaged during said frame-time;

means for activating a number of pulses in a set of said subfields to represent said maximum pixel value to a resolution of said LS digit; and means for activating a number of additional pulses in a subfield that is not a member of said set, wherein said number of additional pulses is less than said LS number, and thus said resolution is enhanced beyond said LS digit.

28. The system of claim 27, wherein said subfield that is not a member of said set has an associated threshold value related to a number of pulses allocated to subfields prior in time in said frame-time, and wherein said system further comprises means for determining said subfield that is not a member of said set based on a relationship between said threshold value and said maximum pixel value.

29. The system of claim 27, wherein said pixel value is an N-bit value, and said display is capable of producing $P(2^N-1)$ pulses in a quantity of Q subfields in said frame-time, and wherein P is an interger greater than 0, and $Q \geqq N$.

30. The system of claim 27, further comprising means for situating said subfield that is not a member of said set at a predetermined position in said frame-time.

31. The system of claim 27, wherein said number of additional pulses is one.

32. The system of claim 27, wherein said number of additional pulses is equal to one half of said least significant number.

33. The system of claim 27, wherein an individual pulse in said subfield that is not a member of said set yields less luminance than that of a pulse in a subfield in said set.

34. The system of claim 27, further comprising:

means for accumulating dead time, wherein said dead time is a time interval during which no pulse is generated;

means for allocating said dead time to a new subfield; and means for situating said new subfield at a predetermined position in said frame-time.

35. The system of claim 27, further comprising, means for limiting an intensity of a pixel associated with a high-luminance region of said image that represents less than a predetermined percentage of said image.

36. The system of claim 27, further comprising, means for inhibiting operation of said means for activating said number of additional pulses when a value of data representing said image has not changed by a predetermined amount as compared to a value of data representing a previous image.

37. The system of claim 28, further comprising means for adjusting said threshold value based on a distribution of pulses in said frame-time that includes said number of additional pulses.

38. The system of claim 28, wherein said maximum pixel value is a current maximum pixel value, and wherein said system further comprises means for adjusting said threshold value so that said relationship is retained until a subsequent maximum pixel value changes by more than a predetermined amount from said current maximum pixel value.

39. The system of claim 27, wherein dead time is a time interval during which no pulse is generated, and wherein said means means for activating said number of additional pulses situates said additional pulses so that said dead time resides at a predetermined position in said frame-time.

* * * * *